US008417139B2

(12) United States Patent
Mukai

(10) Patent No.: US 8,417,139 B2
(45) Date of Patent: Apr. 9, 2013

(54) FIXING DEVICE, IMAGE FORMING APPARATUS, AND METHOD FOR CONTROLLING FIXING DEVICE, EACH OF WHICH IS FOR SETTING TEMPERATURE OF FIXING MEMBER AND TEMPERATURE OF EXTERNAL HEATING SECTION FOR HEATING FIXING MEMBER IN ORDER TO CARRY OUT FIXING PROCESS WITH RESPECT TO RECORDING MATERIAL FOR WHICH SET FIXING TEMPERATURE NEEDS TO BE SET HIGHER THAN WARM-UP COMPLETION TEMPERATURE BY PREDETERMINED TEMPERATURE OR MORE

(75) Inventor: Takashi Mukai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 424 days.

(21) Appl. No.: 12/786,570

(22) Filed: May 25, 2010

(65) Prior Publication Data

US 2010/0303496 A1 Dec. 2, 2010

(30) Foreign Application Priority Data

May 28, 2009 (JP) ..... 2009-129524

(51) Int. Cl.
*G03G 15/20* (2006.01)

(52) U.S. Cl. ..... 399/70

(58) Field of Classification Search ..... 399/69, 399/70, 328, 330
See application file for complete search history.

(56) References Cited

U.S. PATENT DOCUMENTS

| | | | | |
|---|---|---|---|---|
| 7,860,419 | B2 * | 12/2010 | Tateishi et al. | 399/70 |
| 8,027,608 | B2 * | 9/2011 | Mukai et al. | 399/70 |
| 8,032,048 | B2 * | 10/2011 | Monde | 399/70 |
| 2007/0212093 | A1 | 9/2007 | Maeda et al. | |

FOREIGN PATENT DOCUMENTS

| | | |
|---|---|---|
| JP | 08-016027 | 1/1996 |
| JP | 2004-205620 | 7/2004 |
| JP | 2007-241143 | 9/2007 |

* cited by examiner

*Primary Examiner* — William J Royer
(74) *Attorney, Agent, or Firm* — Renner, Otto, Boisselle & Sklar, LLP

(57) ABSTRACT

In a case where a process is carried out with respect to an envelope in a fixing process mode, at least either (i) a set temperature of a fixing roller in a fixing process or (ii) a set temperature of an endless belt in the fixing process which endless belt is provided in an external heating device is changed in accordance with a time period between an end of a warm-up mode and a start of the fixing process mode. This makes it possible to prevent both a wrinkle and inadequate fixing in a fixing process of an envelope carried out by a fixing device of an external heating method.

13 Claims, 8 Drawing Sheets

FIG. 6

| | Immediately After Warm-Up Is Completed | | | | | After Ready State Is Ended | | | | |
|---|---|---|---|---|---|---|---|---|---|---|
| | Temperature Setting | | | Result | | Temperature Setting | | | Result | |
| | Fixing R (TA) | Pressure R | External (TC) | Wrinkle | Fixation Degree | Fixing R (TB) | Pressure R | External (TD) | Wrinkle | Fixation Degree |
| Example 1 | 190°C | 140°C | 230°C | ○ | ○ | 200°C | 140°C | 220°C | ○ | ○ |
| Example 2 | 190°C | 140°C | 220°C | ○ | ○ | 200°C | 140°C | 220°C | ○ | ○ |
| Example 3 | 190°C | 140°C | 220°C | ○ | ○ | 190°C | 140°C | 205°C | ○ | ○ |
| Example 4 | 195°C | 140°C | 230°C | ○ | ○ | 200°C | 140°C | 220°C | ○ | ○ |
| Comparative Example 1 | 200°C | 140°C | 220°C | × | ○ | 200°C | 140°C | 220°C | ○ | ○ |
| Comparative Example 2 | 190°C | 140°C | 190°C | ○ | ○ | 220°C | 140°C | 220°C | ○ | × |
| Comparative Example 3 | 190°C | 140°C | 190°C | × | ○ | 205°C | 140°C | 205°C | ○ | ○ |

FIG. 7

| TIME PERIOD FROM COMPLETION OF WARM-UP | RESULT |
|---|---|
| 0 | × |
| 30 | × |
| 60 | × |
| 90 | △ |
| 120 | ○ |
| 150 | ○ |
| 180 | ○ |

FIXING DEVICE, IMAGE FORMING APPARATUS, AND METHOD FOR CONTROLLING FIXING DEVICE, EACH OF WHICH IS FOR SETTING TEMPERATURE OF FIXING MEMBER AND TEMPERATURE OF EXTERNAL HEATING SECTION FOR HEATING FIXING MEMBER IN ORDER TO CARRY OUT FIXING PROCESS WITH RESPECT TO RECORDING MATERIAL FOR WHICH SET FIXING TEMPERATURE NEEDS TO BE SET HIGHER THAN WARM-UP COMPLETION TEMPERATURE BY PREDETERMINED TEMPERATURE OR MORE

This Nonprovisional application claims priority under 35 U.S.C. §119(a) on Patent Application No. 2009-129524 filed in Japan on May 28, 2009, the entire contents of which are hereby incorporated by reference.

TECHNICAL FIELD

The present invention relates to (i) a fixing device for use in an electrophotographic image forming apparatus, (ii) an image forming apparatus including the fixing device, and (iii) a method for controlling the fixing device.

BACKGROUND ART

A fixing device employing a heat fixing method has been conventionally and commonly used as a fixing device for use in an electrophotographic image forming apparatus which image forming apparatus is often employed in a device such as a copying machine, a laser printer, or a facsimile. Among heat fixing methods, a roller fixing method using a fixing roller is often employed.

According to the roller fixing method, the fixing is carried out as follows. Namely, while a fixing roller and a pressure roller are being pressed against each other, a recording material on which an unfixed toner image is formed is carried to a fixing nip area between the fixing roller and the pressure roller so that toner is heated and melted. This causes the toner to be melted and fixed onto the recording material. Note that each of the fixing roller and the pressure roller is configured so as to house a heater serving as a heat source and so that its outer surfaces is coated with a material such as rubber having a high releasability or resin having a high releasability. According to the roller fixing method, the fixing roller is entirely retained at a predetermined temperature. Therefore, the roller fixing method is suitable for high-speed processing.

In recent years, full-color image forming apparatuses such as full-color laser printers have been widely used.

In general, a full-color image forming apparatus uses toner of the following four colors: magenta, yellow, cyan, and black. In order that the full-color image forming apparatus fixes a full-color toner image, it is necessary to carry out a color mixture of toner of a plurality of colors while the toner is being melted, unlike the fixing of monochrome toner in which fixing the monochrome toner is merely softened and fixed while being pressurized. Therefore, a fixing device for use in the full-color image forming apparatus has to completely melt the toner.

In the case of a fixing device employing a roller fixing method for use in the full-color image forming apparatus, a fixing roller is formed as below. Namely, an elastic body which is a rubber layer made from a material such as silicon rubber is provided on a support made from a material such as a metal having a good heat conductivity. Further, the elastic body is coated with a fluorocarbon resin having a good releasability.

According to the fixing device, the fixing roller with the rubber layer having a low heat conductivity has to be heated to a predetermined temperature at the start-up of the full-color image forming apparatus. Accordingly, an arrangement in which the fixing roller is heated only by a heat source, such as a heater, provided inside the fixing roller has a problem in that it takes a long time period from the power on the full-color image forming apparatus until the full-color image forming apparatus becomes ready for operation. Another problem is that a temperature of the fixing roller decreases during a high-speed continuous operation of the fixing device.

As a solution to the problems, a fixing device employing an external heating and fixing method has been proposed recently. In the fixing device, a belt member (external heating belt) having a small heat capacity is heated and is made to contact with a surface of the fixing roller. This causes the fixing roller to be heated not only from within but also externally.

Patent Literature 1 proposes a control method which gives higher priority to external heating. This is a method for further reducing a warm-up period of a fixing device employing an external heating and fixing method.

In the control method which gives high priority to the external heating, first, only a heat source of an external heating belt is turned on so that the external heating belt is heated to a predetermined first temperature. Thereafter, the heat source of the external heating belt is turned off, and a heat source inside a fixing roller is turned on. When a temperature of the external heating belt decreases to the predetermined first temperature or lower, the heat source inside the fixing roller is turned off, and the heat source of the external heating belt is turned on again. Then, the heat source of the external heating belt is turned off when a temperature of the external heating belt reaches the predetermined first temperature, and the heat source inside the fixing roller is turned on again. This is repeated until the fixing roller reaches a predetermined warm-up completion temperature.

Patent Literature 2 discloses a technique in which a fixing roller is realized by a hard roller and a pressure roller is realized by a soft roller, so that each linear velocity of the fixing roller and the pressure roller is changed during an envelope mode. This can prevent a recording material such as an envelope from being wrinkled while it is being subjected to a fixing process by a fixing device employing a roller fixing method.

Citation List

Patent Literature 1

Japanese Patent Application Publication, Tokukai, No. 2007-241143 A (Publication Date: Sep. 20, 2007)

Patent Literature 2

Japanese Patent Application Publication, Tokukai, No. 2004-205620 A (Publication Date: Jul. 22, 2004)

SUMMARY OF INVENTION

However, the art of Patent Literature 1 has a problem of causing a wrinkle and/or inadequate fixing in a case where a fixing process is carried out with respect to a recording material, such as an envelope, having a fixing temperature which is higher than a fixing temperature of plain paper.

This will be described below with reference to FIGS. 9 and 10. FIG. 9 is a graph showing (i) how temperatures of the fixing roller, the pressure roller, and the external heating belt change over time and (ii) how ON/OFF states of the heat source inside the fixing roller and the heat source of the external heating belt change over time, in a case where a fixing process is carried out with respect to an envelope immediately after a warm-up is completed. FIG. 10 is a graph showing (i) how temperatures of the fixing roller, the pressure roller, and the external heating belt change over time, and (ii) how ON/OFF states of the heat source inside the fixing roller and the heat source of the external heating belt change over time, in a case where a fixing process is carried out with respect to an envelope after sufficient time has elapsed since a shift to a ready state (standby state). The ready state intends to a state in which the temperature of the fixing roller is kept in a predetermined temperature range after completion of the warm-up.

It is necessary to cause a temperature of the fixing roller to be higher than the warm-up completion temperature, in a case where a fixing process (job) is carried out with respect to a recording material, such as an envelope, for which a set temperature of the fixing roller is set to a temperature which is considerably higher than a warm-up completion temperature. However, as shown in FIG. 9, immediately after the warm-up is completed, the external heating belt reaches a temperature close to its target temperature and the inside of the fixing roller is not sufficiently heated. As such, the heat source provided inside the fixing roller exclusively turns ON until a surface temperature of the fixing roller reaches its target temperature.

In general, a fixing roller includes a core pipe, an elastic body layer provided around the core pipe, and a heat source which is realized by a heater lamp such as a halogen lamp and is provided inside the core pipe. The elastic body layer has a relatively low heat conductivity. This causes a time lag between the time when the heat source inside the fixing roller starts heating and the time when a heat is conducted to the surface of the fixing roller via the core pipe and the elastic body layer. Accordingly, in a case where the heat source inside the fixing roller is exclusively turned on so that the surface of the fixing roller is heated to a fixing temperature, a temperature of the core pipe has already reached a temperature higher than a surface temperature of the fixing roller when a fixing process is started after the surface temperature of the fixing roller reaches its target temperature. Then, heat of the core pipe is conducted to the surface of the elastic layer. As a result, a surface temperature of the fixing roller becomes higher than its target temperature (i.e., a so-called overshoot phenomenon). This causes a situation in which thermal expansion of the fixing roller is increased. In such a situation, if a recording material such as an envelope is passed through a fixing nip area, then the recording material is wrinkled due to an excessive pressure acting on the recording material in the fixing nip area.

As a solution to this, it is conceivable that a fixing temperature (a set temperature of the surface of the fixing roller during a fixing process) for the envelope mode is set to a low temperature, in order to suppress thermal expansion of the fixing roller which occurs when the recording material is passed through the fixing nip area.

However, in a case where a job is carried out in the envelope mode after sufficient time has elapsed since a shift to a ready state upon completion of a warm-up, a temperature of the external heating belt is lower than its target temperature, as shown in FIG. 10. Therefore, the heat source of the external heating belt is turned on, so that the heat from the external heating belt is supplied to the surface of the fixing roller. As a result, a temperature of the fixing roller is increased with an increase in temperature of the external heating belt. After the external heating belt reaches its target temperature, the heat source of the external heating belt is turned off, whereas the heat source inside the fixing roller is turned on so that a temperature of the surface of the fixing roller approaches its target temperature. However, the heat source inside the fixing roller keeps turning ON for a relatively short time period because the temperature of the surface of the fixing roller has been previously increased to a certain extent due to the heat supply from the external heating belt. Accordingly, an overshoot phenomenon is less likely to occur, and thermal expansion of the fixing roller is small.

Therefore, in a case where a fixing temperature is set to a low temperature during a fixing process of an envelope so that the thermal expansion of the fixing roller is suppressed immediately after a warm-up is completed, the pressure at the fixing nip area becomes too small, during the fixing process which is carried out after a certain time period has elapsed since the warm-up mode is shifted to the ready state (standby state), because the thermal expansion of the fixing roller is too small. This causes a failure to apply proper heat to an unfixed toner image. As a result, there occurs inadequate fixing such as a low-temperature offset.

Therefore, it has been difficult to properly prevent both a wrinkle and inadequate fixing from occurring in a job to be carried out immediately after a warm-up and in a job to be carried out after the ready state.

According to Patent Literature 2, it is necessary for each of the fixing roller and the pressure roller to include a drive device, in order that respective linear speeds of the fixing roller and the pressure roller are varied from each other. This causes problems of an increase in complexity of a device arrangement, an increase in device size, and an increase in manufacturing costs.

The present invention was made in view of the problems. An object of the present invention is to provide a fixing device, with a simple arrangement, which makes it possible to prevent both a wrinkle and inadequate fixing regardless of a type of a recording material and regardless of a state of the fixing device.

In order to attain the object, a fixing device of the present invention includes: a fixing member including a cylindrical core pipe and an elastic layer covering an outer surface of the cylindrical core pipe, the fixing member being rotatably provided around an axis extending in which the cylindrical core pipe extends; a pressure member which pressures the fixing member; an internal heating section, provided inside the fixing member, for heating the fixing member from within; an external heating section, provided so as to face the outer surface of the fixing member, for heating an outer surface of the fixing member; a first temperature sensing section for detecting a temperature of a contact surface of the fixing member, the contact surface making contact with the pressure member; a second temperature sensing section for detecting a temperature of a facing surface of the external heating section, the facing surface facing the fixing member; and a control section for controlling the internal heating section and the external heating section in accordance with results detected by the respective first and second temperature sensing sections, said fixing device causing a recording material, inserted between the fixing member and the pressure member, to be carried while the recording material is being sandwiched so that an unfixed image on the recording material is fixed onto the recording material, said control section having (i) a warm-up mode in which a surface of the fixing member is heated up to a predetermined warm-up completion temperature, (ii) a standby mode in which the surface of the fixing member is maintained within a predetermined standby temperature range, during a time period in which no fixing process is carried out and after the warm-up mode is completed, and (iii) a fixing process mode in which a fixing process is carried out with respect to the recording material, and, said control section changing, in accordance with a time period between an end of the warm-up mode and a start of the fixing process mode, at least one of (i) a set fixing temperature which is a set temperature of the contact surface of the fixing member in a fixing process and (ii) a set external heating temperature which is a set temperature of the facing surface of the external heating section in a fixing process, in a case where a fixing process is carried out, in the fixing process mode, with respect to a predetermined type of recording material for which the set fixing temperature needs to be set higher, by a predetermined temperature or more, than the warm-up completion temperature.

According to the arrangement, the fixing device includes: the fixing member which includes the cylindrical core pipe and the elastic layer covering the outer surface of the cylindrical core pipe; the internal heating section, provided inside the fixing member, for heating the fixing member from within; and the external heating section, provided so as to face the outer surface of the fixing member, for heating the outer surface of the fixing member. In addition, the fixing device includes: the first temperature sensing section for detecting the temperature of the contact surface of the fixing member; the second temperature sensing section for detecting the temperature of the facing surface of the external heating section; and the control section for controlling the internal heating section and the external heating section in accordance with the results detected by the respective first and second temperature sensing sections. Further, the control section has: (i) the warm-up mode in which the surface of the fixing member is heated up to the predetermined warm-up completion temperature, (ii) the standby mode in which the surface of the fixing member is maintained within the predetermined standby temperature range, during a time period in which no fixing process is carried out and after the warm-up mode is completed, and (iii) the fixing process mode in which a fixing process is carried out with respect to the recording material.

In the case of such a fixing device, respective temperatures of the core pipe and the elastic layer which are provided in the fixing member can differ between immediately after the warm-up mode is completed and after a long time period elapses since the standby mode is started, even if a surface temperature of the fixing member is the same.

Therefore, according to the arrangement, in accordance with the time period between the end of the warm-up mode and the start of the fixing process mode, the control section changes at least one of (i) the set fixing temperature which is a set temperature of the contact surface of the fixing member in a fixing process and (ii) the set external heating temperature which is a set temperature of the facing surface of the external heating section in a fixing process, in a case where a fixing process is carried out, in the fixing process mode, with respect to a predetermined type of recording material for which the set fixing temperature needs to be set higher, by a predetermined temperature or more, than the warm-up completion temperature. This makes it possible to prevent the recording material from being wrinkled by a too large pressure caused by a too large thermal expansion of the fixing member, even if a process is carried out in the fixing process mode with respect to the predetermined type of recording material for which a set fixing temperature needs to be set higher, by the predetermined value or more, than the warm-up completion temperature. In addition, this makes it possible to prevent inadequate fixing, such as a low-temperature offset, which is caused because a pressure acting on the recording material is too small due to a too small thermal expansion of the fixing member.

Advantageous Effects of Invention

As described above, in accordance with the time period between the end of the warm-up mode and the start of the fixing process mode, the control section changes at least one of (i) the set fixing temperature which is a set temperature of the contact surface of the fixing member in a fixing process and (ii) the set external heating temperature which is a set temperature of the facing surface of the external heating section in a fixing process, in a case where a fixing process is carried out, in the fixing process mode, with respect to a predetermined type of recording material for which the set fixing temperature needs to be set higher, by predetermined temperature or more, than the warm-up completion temperature.

This makes it possible to prevent the recording material from being wrinkled by a too large pressure caused by a too large thermal expansion of the fixing member, even if a process is carried out in the fixing process mode with respect to the predetermined type of recording material. In addition, this makes it possible to prevent inadequate fixing, such as a low-temperature offset, which is caused because a pressure acting on the recording material is too small due to a too small thermal expansion of the fixing member.

BRIEF DESCRIPTION OF DRAWINGS

FIG. 6 is a table showing results of experiments conducted by use of the fixing device illustrated in FIG. 1.

FIG. 7 is a table showing results of experiments conducted by use of the fixing device illustrated in FIG. 1.

DESCRIPTION OF EMBODIMENTS

The following describes one embodiment of the present invention.

<1. Arrangement of Color Image Forming Apparatus 10>

Figure 2:
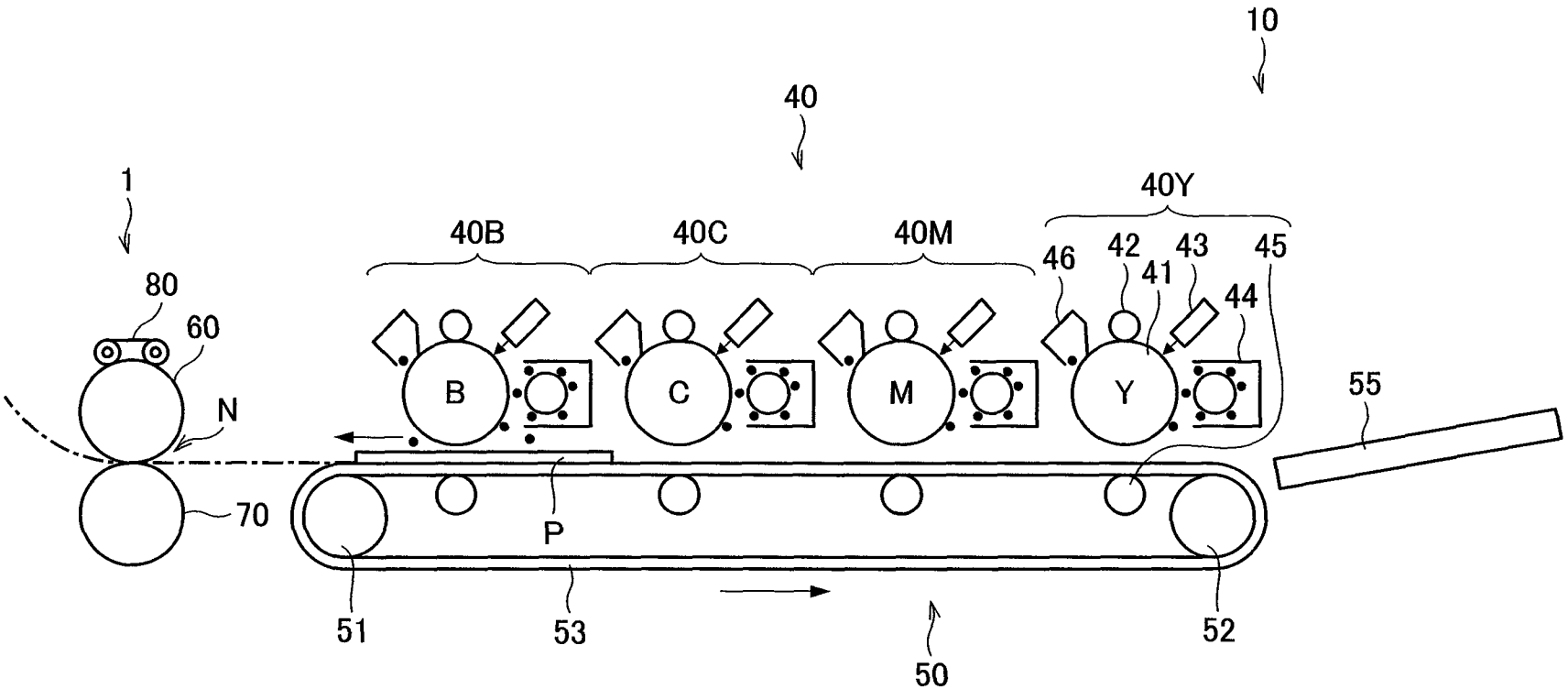
FIG. 2 is a schematic diagram illustrating an arrangement of an image forming apparatus including the fixing device illustrated in FIG. 1.

FIG. 2 is a cross-sectional view illustrating a schematic arrangement of a color image forming apparatus (image forming apparatus) 10 of the present embodiment.

As illustrated in FIG. 2, the color image forming apparatus 10 is a so-called tandem-type printer in which visible image forming units (image forming units) 40 (40Y, 40M, 40C, and 40B) corresponding to respective four (4) colors are arranged along a carrying path for a recording material P. Specifically, the color image forming apparatus 10 includes: (i) recording material carrying means 50 for carrying the recording material P along the carrying path connecting a supply tray 55 of the recording material P to a fixing device 1, and (ii) four (4) visible image forming units 40Y, 40M, 40C, and 40B which are provided along the carrying path. The visible image forming units 40Y, 40M, 40C, and 40B transfer, in multiple, toner images of the respective four colors onto the recording material P which is carried along the carrying path by the recording material carrying means 50. Then, the toner images are fixed onto the recording material P by the fixing device 1, thereby forming a full-color image.

The recording material carrying means 50 includes a driving roller 51, an idling roller 52, and an endless carrying belt 53 provided in a tensioned state between the driving roller 51 and the idling roller 52. The carrying belt 53 is rotated along the carrying path at a predetermined peripheral velocity by rotating and driving the driving roller with the use of driving means (not illustrated). This causes the carrying belt 53 to carry the recording material P which is electrostatically-adsorbed onto the carrying belt 53. Note, in the present embodiment, that a carrying speed at which the recording material P is carried, i.e., a processing speed, is set to 113 mm/s.

Each of the visible image forming units 40 includes a photoreceptor drum 41, around which a charging roller 42, laser irradiation means 43, a developing device 44, a transfer roller 45, and a cleaner 46 are provided. The developing devices 44 of the respective visible image forming units 40Y, 40M, 40C, and 40B contain yellow (Y) toner, magenta (M) toner, cyan (C) toner, and black (B) toner, respectively. Each of the visible image forming units 40 forms a toner image on the recording material P in accordance with the following steps.

Specifically, in each of the visible image forming units 40, a surface of the photoreceptor drum 41 is charged uniformly by the charging roller 42, and then is subjected to laser exposure by the laser irradiation means 43 in accordance with image information. This causes an electrostatic latent image to be formed. Then, the electrostatic latent image on the photoreceptor drums 41 is developed by the developing device 44 so that the toner image becomes visible. By use of the transfer roller 45 to which a bias voltage having a polarity opposite to a polarity of toner has been applied, the toner image which has become visible is sequentially transferred onto the recording material P which is carried by the recording material carrying means 50. Then, the recording material P onto which the toner images of the respective four colors are transferred is stripped off from the carrying belt 53 due to a curvature of the driving roller 51. Thereafter, the recording material P is carried toward the fixing device 1. Then, the fixing device 1 appropriately applies heat and pressure to the recording material P. This causes the toner to be melted and be then fixed onto the recording material P, so that a robust image is formed.

<2. Arrangement of Fixing Device 1>

The following describes an arrangement of the fixing device 1. The fixing device 1 applies heat and pressure to an unfixed toner image formed on a surface of the recording material P so as to fix the unfixed toner image onto the recording material P. The unfixed toner image is formed by use of a developer (toner) such as a nonmagnetic single component developer (nonmagnetic toner), a nonmagnetic two component developer (nonmagnetic toner and carrier), or a magnetic developer (magnetic toner).

Figure 1:
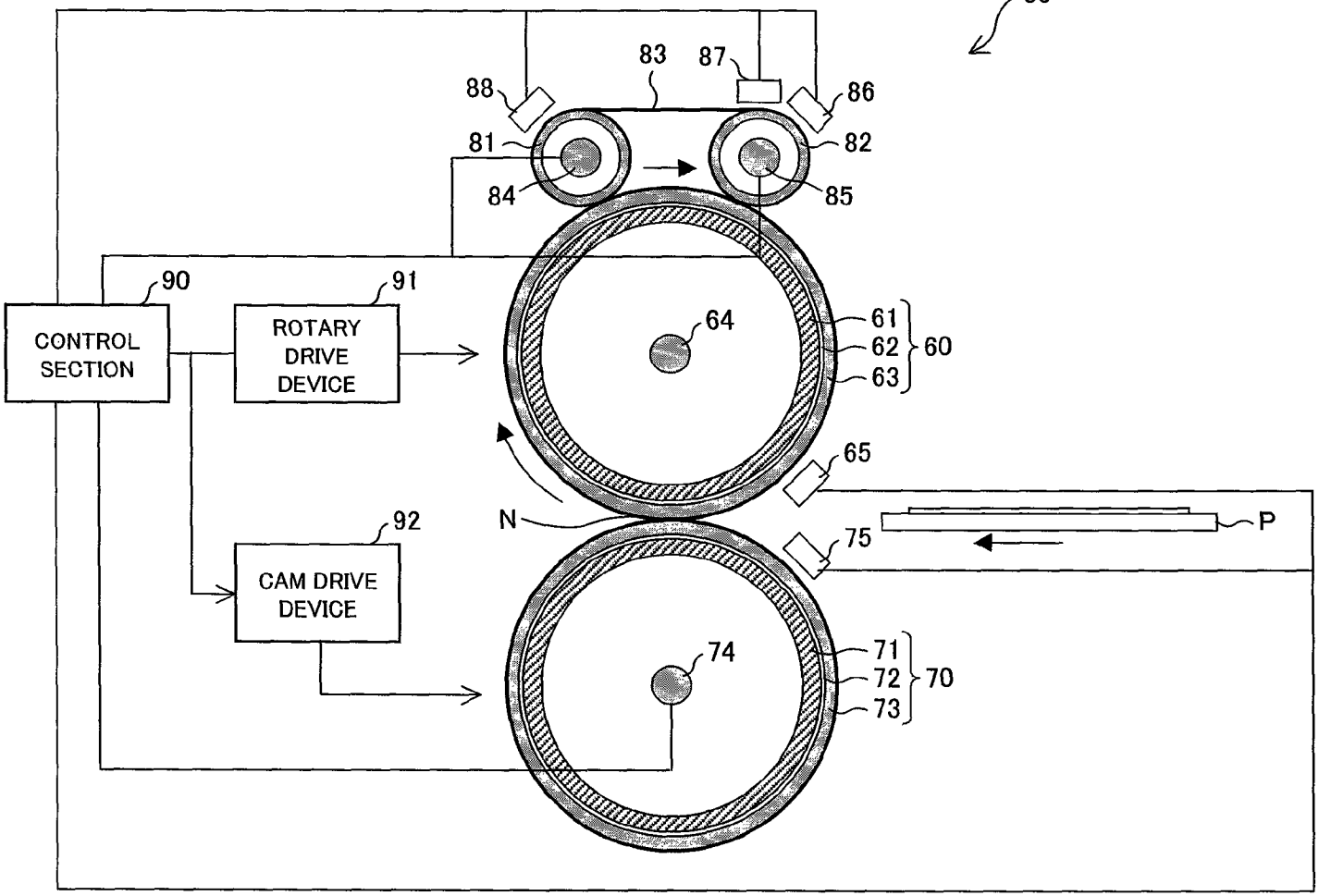
FIG. 1 is a schematic diagram illustrating a schematic arrangement of a fixing device of the one embodiment of the present invention.

FIG. 1 is a schematic diagram illustrating an arrangement of the fixing device 1. As illustrated in FIG. 1, the fixing device 1 includes a fixing roller (fixing member) 60, a pressure roller (pressure member) 70, an external heating device (external heating section) 80, a control section 90, a rotary drive device 91, and a cam drive device 92.

When the recording material P is carried to an area (a fixing nip area N) between the fixing roller 60 and the pressure roller 70 while they are being heated to a predetermined fixing temperature, the fixing roller 60 and the pressure roller 70 are pressured against each other at a predetermined load via the recording material P. The fixing roller 60 and the pressure roller 70 carries the recording material P while sandwiching the recording material P between the fixing roller 60 and the pressure roller 70. This causes the unfixed toner image (unfixed image) on the recording material P to be fixed onto the recording material P by heat of a peripheral surface of the fixing roller 60. When the recording material P passes through the fixing nip area N, the fixing roller 60 makes contact with a surface of the recording material P on which surface a toner image is formed while the pressure roller 70 makes contact with a surface of the recording material P which surface is opposite to the surface where the toner image is formed.

The fixing roller 60 has a three-layered structure in which a core pipe 61, an elastic layer 62, and a release layer 63 are provided in this order from within. The core pipe 61 is made from a metal such as iron, stainless steel, aluminum, copper, or any of their alloys. A suitable material for the elastic layer 62 is silicon rubber. A suitable material for the release layer is a fluororesin such as PFA (copolymer of tetrafluoroethylene and perfluoroalkylvinylether) or PTFE (polytetrafluoroethylene). Note that the materials for the core pipe 61, the elastic layer 62, and the release layer 63 are not limited to those materials. Note also that the release layer is not necessarily provided. The present embodiment adopts, as the fixing roller 60, a roller made as below. A core pipe which is made from aluminum and has a thickness of 2 mm is coated with a silicone rubber layer having thickness of 2.5 mm, and the silicone rubber layer is further coated with a PFA tube having a thickness of 40 μm, thereby obtaining a roller having an outer diameter of 40 mm.

In the fixing roller 60, a heater lamp (internal heating section) 64 for heating the fixing roller 60 from within is provided in a longitudinal direction (a direction in which the fixing roller 60 extends) of the fixing roller 60. A thermistor (first temperature sensing section) 65 for detecting a surface temperature of an outer surface (a surface making contact with the pressure roller 70, an endless belt 83, and the recording material P) of the fixing roller 60 is provided in the vicinity of the fixing roller 60. The control section 90 controls electric power, which is supplied from a power supply circuit (not illustrated) to the heater lamp 64. This causes the heater lamp 64 to emit light in accordance with the electric power, so as to radiate infrared rays. The infrared rays are absorbed by an inner surface of the core pipe 61 of the fixing roller 60. As a result, the fixing roller 60 is entirely heated.

The fixing roller 60 is driven to rotate by the rotary drive device 91 having a drive transmission mechanism in which members such as a driving motor and a gear are provided. The control section 90 controls the rotary drive device 91, so that the rotation of the fixing roller 60 is controlled.

As is the case with the fixing roller 60, the pressure roller also has an elastic layer 72 on an outer surface of a core pipe 71. The elastic layer 72 is made from silicone rubber or the like. The core pipe 71 is made from a metal such as iron, stainless steel, or aluminum. Further, a release layer 73 made from PFA or the like is formed on the elastic layer 72. The present embodiment adopts, as the pressure roller 70, a roller having a same arrangement as the fixing roller 60. The pressure roller 70 houses a heater lamp 74 for heating the pressure roller 70. In addition, a thermistor 75 for detecting a surface temperature of the pressure roller 70 is provided in the vicinity of the pressure roller 70.

The control section 90 controls electric power which is supplied from the power circuit (not illustrated) to the heater lamp 74, thereby heating the pressure roller 70 entirely, as is the case with the fixing roller 60. Note, in the present embodiment, that the pressure roller 70 rotates by contacting the rotating fixing roller 60. However, the present embodiment is not limited to this but the pressure roller 70 can be driven to rotate separately from the rotation of the fixing roller 60.

The cam drive device 92 is provided for adjusting a distance between rotary shafts of the fixing roller 60 and the pressure roller 70. Specifically, the pressure roller 70 is movably provided toward the fixing roller 60. Two arm members (not illustrated) have contact with both ends of the pressure roller 70, on respective sides opposite to the fixing roller 60. One end of each of the two arm members is rotatably supported around an axis while the other end is biased toward the fixing roller 60 by an elastic member (not illustrated) such as a spring. A cam member (not illustrated) has contact with that surface of each of the two arm members which is one on a pressure roller 70 side. The cam drive device 92 causes cam members to rotate in response to the control section 90 so that each of the two arm members is rotated around the one end. This causes the pressure roller 70 to be moved with respect to the fixing roller 60. In accordance with a type of the recording material P to be subjected to the fixing process, the control section 90 adjusts a distance between the shafts of the fixing roller 60 and the pressure roller 70 so that a predetermined load is applied to the recording material P in the fixing process. The present embodiment is arranged such that the cam drive device 92 can carry out a two-stage change in the distance. However, the present embodiment is not limited to this but the dam drive device 92 can carry out a three or more multiple-stage change in the distance.

The external heating device (external heating section) includes: the endless belt (external heating belt) 83; supporting rollers 81 and 82 for suspending and heating the endless belt 83; heater lamps 84 and 85 which are heat sources for heating the endless belt 83 via the supporting rollers 81 and 82; thermistors 86 and 88 (second temperature sensing sections) for detecting a surface temperature of that surface (a surface facing the fixing roller 60) of the endless belt 83 which makes contact with the fixing roller 60; and a thermostat 87 for automatically shutting off power supply to the heater lamps 84 and 85 when the surface temperature of the endless belt 83 is increased to a predetermined temperature or higher.

Each of the supporting rollers 81 and 82 is a cylindrical metal core pipe made from a material such as aluminum or an iron-base material. The hollow cylindrical metal core pipe can be coated with a material such as a fluororesin, in order that a deviation force (a force acting in an in-plane direction of the endless belt 83 which in-plane direction is perpendicular to a rotation direction of the endless belt 83) that acts on the endless belt 83 is reduced. The present embodiment adopts, as the supporting rollers 81 and 82, rollers each having an outer diameter of 16 mm and each made from an aluminum plate having a thickness of 2.0 mm The endless belt 83 is provided for heating a surface of the fixing roller 60 while the endless belt 83 is being heated to a predetermined temperature and is making contact with the surface. The endless belt 83 is provided upstream, with respect to a rotation direction of the fixing roller 60, from the fixing nip area N. The endless belt 83 is pressured against the fixing roller 60 at a predetermined load. The endless belt 83 rotates by contacting the rotating fixing roller 60. The supporting rollers 81 and 82 rotates by contacting the rotating endless belt 83.

A belt adopted as the endless belt 83 has an arrangement in which a polyimide base material is coated with a fluororesin which is a mixture of PFTE and PFA each serving as a release layer. An arrangement of the endless belt 83 is not limited to this. For example, the endless belt 83 can have a two-layered structure in which a release layer made of a synthetic resin material (e.g., a fluororesin such as PFA or PTFE) having a good heat resistance and a good releasability is formed on a base material made from a heat-resistant resin except polyimide or is made from a metal material such as stainless steel or nickel. In order that a deviation force which acts on the endless belt 83 is reduced, a material such as a fluororesin can coat an inner surface of a belt base material.

As described above, the thermistors 65, 75, 86, and 88 are provided, each serving as temperature sensing means, in the vicinity of respective outer surfaces of the fixing roller 60, the pressure roller 70, and the endless belt 83 so as to detect respective surface temperatures. The control section 90 controls the electric power, which is supplied to each of the heater lamps, in accordance with data of a temperature detected by a corresponding one of the thermistors so as to maintain each predetermined temperature of the fixing roller 60, the pressure roller 70, and the endless belt 83. The present embodiment adopts, as the temperature sensing means, the thermistors. However, the present embodiment is not limited to this. Instead, a contact thermistor or a noncontact temperature sensor which detects a temperature by detecting infrared rays radiated from an outer surface can be adopted. Instead, a combination of contact and noncontact temperature sensors can be adopted.

<3. Control Method of Fixing Device 1>

The following describes a method for controlling the fixing device 1. The fixing device 1 has a warm-up mode, a ready mode, a fixing process mode, and a sleep mode. In the warm-up mode, a surface temperature of the fixing roller 60 is increased to a predetermined warm-up completion temperature in a case where a job is started when the surface temperature of the fixing roller 60 is lower than a predetermined warm-up start temperature (e.g., 70° C.) (i) immediately after turning on power of the color image forming apparatus 10 or (ii) in a sleep mode in which the color image forming apparatus 10 is on standby with a minimum power consumption. In the ready mode (standby mode), a surface temperature of the fixing roller 60 is maintained within a predetermined standby temperature range which is higher than the warm-up start temperature, during a period in which no fixing process is carried out after a warm-up is completed. In the fixing process mode, a fixing process is carried out with respect to the recording material P. In the sleep mode, the color image forming apparatus 10 is on standby with a minimum power consumption in a case where a state, in which no instruction to carry out a job is entered, has been kept in the ready mode for not less than a predetermined time period.

<3-1. Warm-up Mode>

Figure 3:
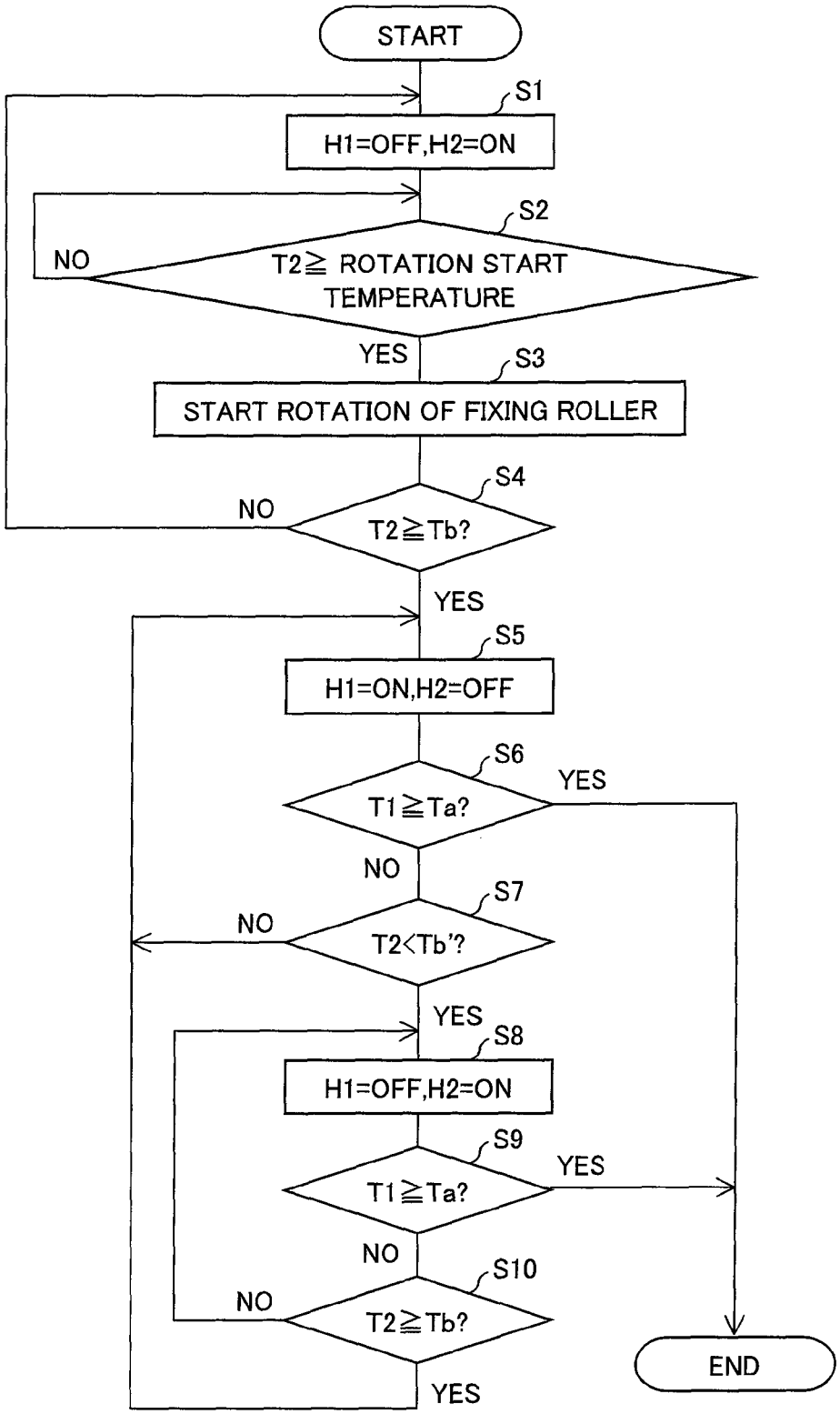
FIG. 3 is a flowchart showing a processing flow for a warm-up mode of the fixing device illustrated in FIG. 1.

The following description first discusses a method for controlling the warm-up mode. FIG. 3 is a flowchart showing how processing is carried out in the warm-up mode. In FIG. 3, H1 indicates the heater lamp 64 provided inside the fixing roller 60 while H2 indicates the heater lamps 84 and 85 provided in the external heating device 80. T1 indicates a surface temperature of the fixing roller 60 while T2 indicates a surface temperature of the endless belt 83. Ta indicates a target temperature (warm-up completion temperature) of the fixing roller 60. In the present embodiment, the target temperature Ta is set to 185° C. Tb indicates a target temperature of the endless belt 83 (a set external warm-up temperature; a temperature at which the heater lamps 84 and 85 are turned off and the heater lamp 64 is turned on). In the present embodiment, the target temperature Tb is set to 225° C. Tb' indicates a reheating start temperature of the endless belt 83 (a temperature at which the heater lamp 64 is turned off and the heater lamps 84 and 85 are turned on). In the present embodiment, the reheating start temperature Tb' is set to 223° C.

First, the control section 90 supplies an electric power to the heater lamps 84 and 85 in the external heating device 80 (H2=ON) (S1). Then, the control section 90 determines, based on a temperature of the endless belt 83 detected by the thermistor 88, whether or not the temperature of the endless belt 83 has reached a predetermined fixing roller rotation start temperature (150° C. in the case of the present embodiment) (S2). If NO in S2, the control section 90 repeats S2 while continuing to supply the electric power to the heater lamps 84 and 85.

If YES in S2, the control section 90 controls the fixing roller 60 to start being driven to rotate by the rotary drive device 91 (S3) while continuing to supply the electric power to the heater lamps 84 and 85.

Then, based on a temperature of the endless belt 83 detected by the thermistor 88, the control section 90 determines whether or not the temperature has reached the target temperature Tb of the endless belt 83 (S4). If NO in S4, the control section 90 repeats S4 while continuing to supply the power supply to the heater lamps 84 and 85.

If YES in S4, the control section 90 shuts off supplying of the electric power to the heater lamps 84 and 85 (H2=OFF), and starts to supply the electric power to the heater lamp 64 inside the fixing roller 60 (H1=ON) (S5).

Then, the control section 90 determines, based on a temperature detected by the thermistor 65, whether or not a surface temperature of the fixing roller 60 has reached the target temperature Ta (S6). If YES in S6, the control section 90 ends the operations of the warm-up mode. Note that, if an instruction to execute a job (fixing process) has been entered at this stage, then there occurs a shift from the warm-up mode to the fixing process mode. If not, then there occurs a shift from the warm-up mode to the ready mode. How the fixing process mode and the ready mode operate is described later.

If NO in S6, the control section 90 determines whether or not a temperature of the endless belt 83 is lower than the reheating start temperature Tb' (S7). If NO in S7, the process is returned to S5.

If YES in S7, the control section 90 shuts off supplying of the electric power to the heater lamp 64 inside the fixing roller 60 (H1=OFF), and starts to supply the electric power to the heater lamps 84 and 85 (H2=ON) (S8).

Then, the control section 90 determines whether or not a surface temperature of the fixing roller 60 has reached the target temperature Ta (S9). If YES in S9, the control section 90 ends the operations of the warm-up mode. Then, if an instruction to execute a job (fixing process) has been entered at this stage, then there occurs a shift from the warm-up mode to the fixing process mode. If not, then there occurs a shift from the warm-up mode to the ready mode. How the fixing process mode and the ready mode operate is described later.

If NO in S9, the control section 90 determines whether or not a temperature of the endless belt 83 has reached the target temperature Tb again (S10). If YES in S10, the process is returned to S5. If NO in S10, the process is returned to S8.

In the warm-up mode, the control section 90 supplies an electric power to the heater lamp 74 inside the pressure roller 70 (i.e., turns on the heater lamp 74) in a case where a surface temperature of the pressure roller 70 is lower than the target temperature of the pressure roller 70. In a case where the surface temperature of the pressure roller 70 is not lower than the target temperature, the control section 90 shuts off supplying of the electric power to the heater lamp 74 (i.e., turns off the heater lamp 74).

Thus, the control section 90 carries out ON/OFF control with respect to the heater lamps 84, 85, and 64, after the temperature of the endless belt 83 has reached the target temperature Tb and until the surface temperature of the fixing roller 60 reaches the target temperature Ta. This causes the temperature of the endless belt 83 to be maintained at a temperature of not lower than the reheating start temperature Tb'. In other words, the control section 90 carries out the ON/OFF control (i) so that the heater lamp 64 provided inside the fixing roller 60 is turned OFF while the heater lamps 84 and 85 provided in the external heating device 80 are turned ON and (ii) so that the heater lamp 64 is turned ON while the heater lamps 84 and 85 are turned OFF. The control section 90 ends the operations of the warm-up mode in a case where the surface temperature of the fixing roller 60 has reached the target temperature Ta.

<3-2. Ready Mode>

The following description discusses a method for controlling the ready mode. The control section 90 carries out operations of the ready mode in a case where an instruction to execute a next job has not been entered at completion of a warm-up or at completion of the fixing process mode.

Figure 4:
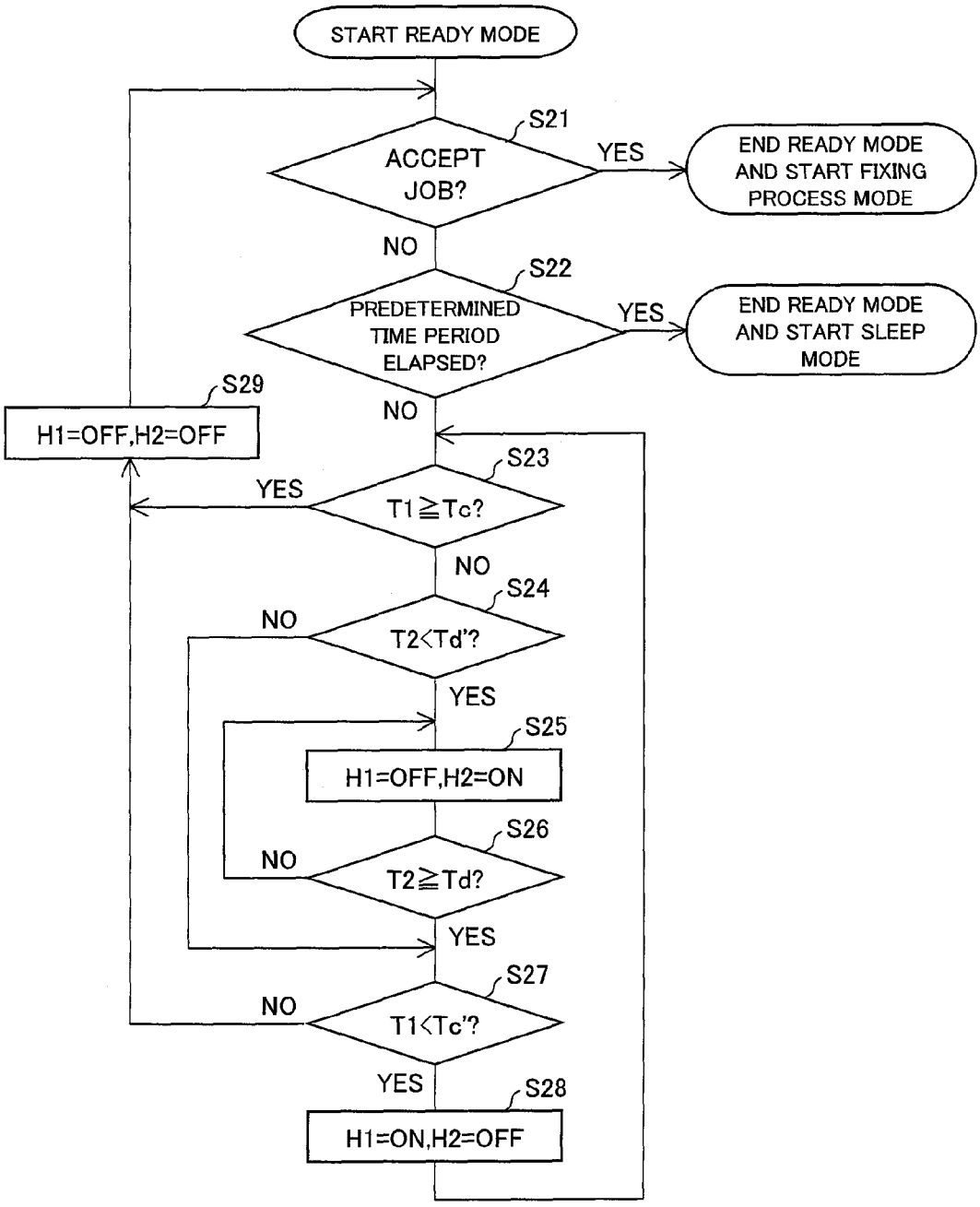
FIG. 4 is a flowchart showing a processing flow for a ready mode of the fixing device illustrated in FIG. 1.

FIG. 4 is a flowchart showing how a processing is carried out in the ready mode. In FIG. 4, Tc indicates a target temperature (185° C. in the present embodiment) of the fixing roller 60. Td indicates a target temperature (185° C. in the present embodiment) of the endless belt 83. Tc' is a reheating start temperature (183° C. in the present embodiment) of the fixing roller 60. Td' indicates a reheating start temperature (183° C. in the present embodiment) of the endless belt 83. Note that H1, H2, T1, and T2 are the same as those shown in FIG. 3. In the ready mode, the target temperature Td of the endless belt 83 is set lower than the target temperature Tb of the endless belt 83 in the warm-up mode, to the extent that heat history in a contact area between the endless belt 83 and the fixing roller 60 does not remain on the outer surface of the fixing roller 60.

As shown in FIG. 4, upon a shift from the warm-up mode to the ready mode, the control section 90 first determines whether or not an instruction to execute a job (fixing process) has been entered (S21). Note that the instruction is entered by a user via a device such as (i) an operation panel (not illustrated) provided in the color image forming apparatus 10 or (ii) an external device (not illustrated) such as a personal computer which is connected with the color image forming apparatus 10 so that the color image forming apparatus 10 can communicate with the external device.

In a case where the instruction has been entered, the control section 90 causes a shift from the ready mode to the fixing process mode.

In a case where no instruction to execute a job has been entered, the control section 90 determines whether or not a predetermined time period (e.g., 30 minutes) has elapsed since a shift to the ready mode (S22). If YES in S22, the control section 90 causes a shift from the ready mode to the sleep mode (energy-saving mode). In the sleep mode, an electric power is supplied only to minimal functions for accepting an instruction input from a user. Accordingly, no electric power is supplied to the heater lamps in the fixing device 1.

If NO in S22, the control section 90 determines whether or not a temperature of the fixing roller 60 is not lower than the target temperature Tc (S23). If YES in S23, the control section 90 controls the heater lamps 64, 84, and 85 to turn off (S29), and the process is returned to S21.

If NO in S23, the control section 90 determines whether or not the temperature of the endless belt 83 is lower than the reheating start temperature Td' (S24). If YES in S24, the control section 90 controls the heater lamp 64 to turn off (H1=OFF), and controls the heater lamps 84 and 85 to turn on (H2=ON) (S25). Then, the control section 90 determines whether or not a temperature of the endless belt 83 has reached the target temperature Td of the endless belt 83 (S26). If NO in S26, the process is returned to S25.

If NO in S24 or if YES in S26, the control section 90 determines whether or not a temperature of the fixing roller 60 is lower than the reheating start temperature Tc' (S27). If YES in S27, the control section 90 controls the heater lamp 64 to turn on (H1=ON), and controls the heater lamps 84 and 85 to turn off (H2=OFF) (S28). Then, the process is returned to S23. If NO in S27, the control section 90 controls the heater lamps 64, 84, and 85 to turn off (H1=OFF, H2=OFF) (S29). Then, the process is returned to S21.

The above processes cause, in the ready mode, a surface temperature of the fixing roller 60 and a temperature of the endless belt 83 to be maintained within a predetermined temperature range (85° C.±a few degrees in the case of in the present embodiment).

The control section 90 controls, in the ready mode, the heater lamp 74 inside the pressure roller 70 to be turned OFF while the heater lamps 84 and 85 are turning ON. In a case where the heater lamps 84 and 85 are turned OFF, the control section 90 controls (i) the heater lamp 74 to turn ON until the surface temperature of the pressure roller 70 reaches the target temperature of the pressure roller 70 and (ii) the heater lamp 74 to turn off when the surface temperature of the pressure roller 70 reaches the target temperature.

<3-3. Fixing Process Mode>

Figure 5:
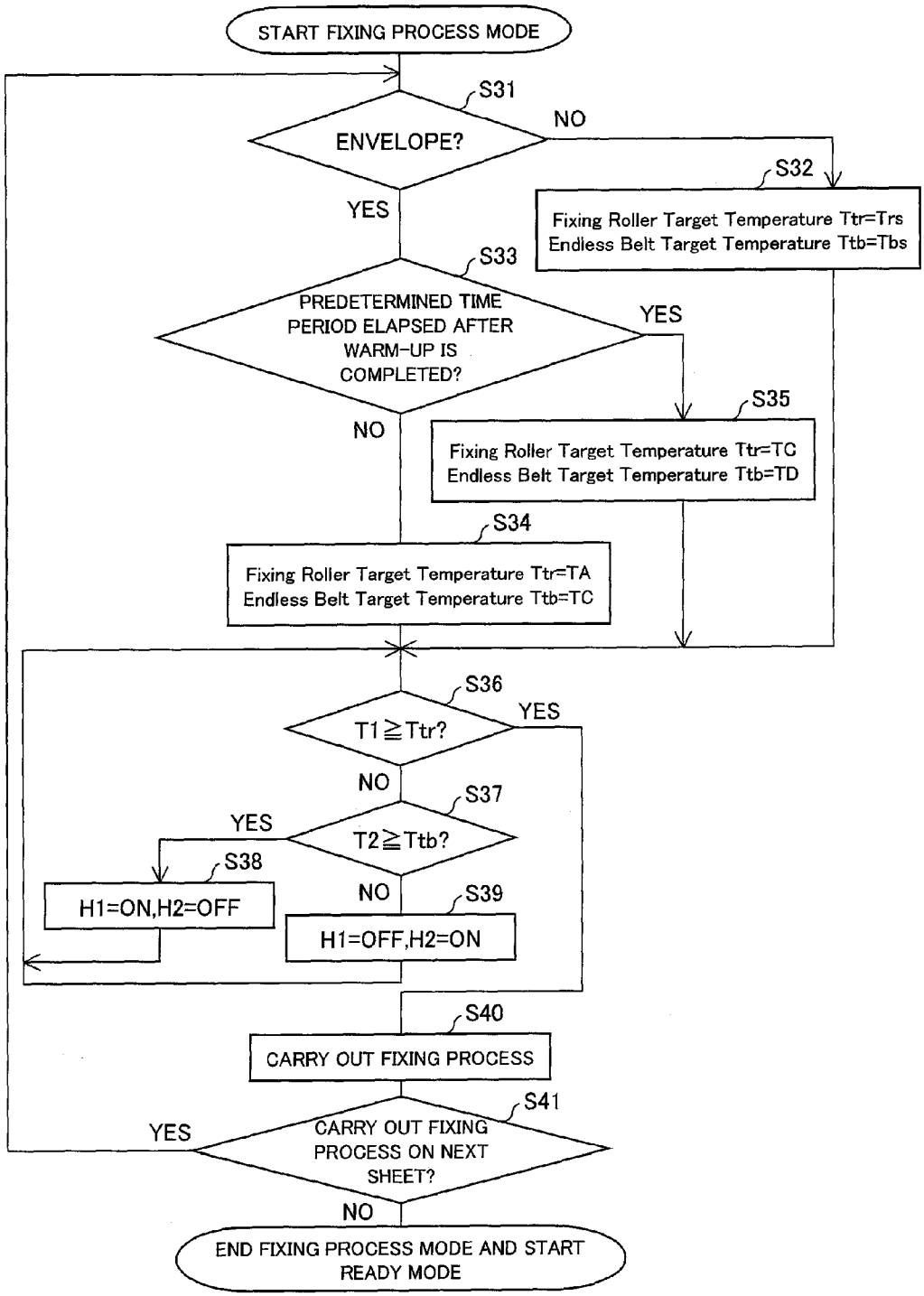
FIG. 5 is a flowchart showing a processing flow for a fixing process mode of the fixing device illustrated in FIG. 1.

The following description discusses a method for controlling the fixing process mode. FIG. 5 is a flowchart illustrating a processing flow for the fixing process mode.

Note, in FIG. 5, that (i) Ttr indicates a target temperature (set fixing temperature) of the fixing roller 60 while Ttb indicates a target temperature (set external heating temperature) of the endless belt 83 and (ii) H1, H2, T1, and T2 are the same as those shown in FIGS. 3 and 4.

According to the present embodiment, the target temperature Ttr of the fixing roller 60 and the target temperature Ttb of the endless belt 83 are changed in accordance with (i) a type of a recording material to be subjected to the fixing process and (ii) an elapsed time from completion of the warm-up mode to entering of an instruction to execute a job.

Specifically, in a case where a fixing process is carried out with respect to a sheet of plain paper, the target temperature Ttr of the fixing roller 60 is set so as to satisfy Ttr=Trs=190° C. while the target temperature Ttb of the endless belt 83 is set so as to satisfy Ttb=Tbs=220° C. In a case where (i) an envelope is subjected to a fixing process and (ii) an elapsed time from completion of the warm-up mode is shorter than a predetermined time period (shorter than 120 seconds in the case of the present embodiment), the target temperature Ttr of the fixing roller 60 is set so as to satisfy Ttr=TA (in the present embodiment, TA=190° C.) while the target temperature Ttb of the endless belt 83 is set so as to satisfy: Ttb=TC (TC=230° C. in the case of the present embodiment). In a case where (i) an envelope is subjected to a fixing process and (ii) an elapsed time from completion of the warm-up mode is not shorter than a predetermined time period (120 seconds or longer in the case of the present embodiment), the target temperature Ttr of the fixing roller 60 is set so as to satisfy Ttr=TB (TB=200° C. in the case of the present embodiment) while the target temperature Ttb of the endless belt 83 is set so as to satisfy Ttb=TD (TD=220° C. in the case of the present embodiment).

In a case where a mode is shifted to the fixing process mode upon accepting a job, the control section 90 first determines whether a piece of plain paper or an envelope is subjected to a fixing process (S31), as shown in FIG. 5.

If it is determined in S31 that a piece of plain paper is subjected to a fixing process, the control section 90 sets the target temperature Ttr of the fixing roller 60 so as to satisfy Ttr=Trs=190° C. while setting the target temperature Ttb of the endless belt 83 so as to satisfy Ttb=Tbs=220° C. (S32).

If it is determined in S31 that an envelope is subjected to a fixing process, the control section 90 determines whether or not an elapsed time from completion of the warm-up mode to acceptance of the job is not shorter than the predetermined time (120 seconds in the case of the present embodiment) (S33). If NO in S33, the control section 90 sets the target temperature Ttr of the fixing roller 60 so as to satisfy Ttr=TA=190° C. while setting the target temperature Ttb of the endless belt 83 so as to satisfy Ttb=TC=230° C. (S34). If YES in S33, the control section 90 sets the target temperature Ttr of the fixing roller 60 so as to satisfy Ttr=TC=200° C. while setting the target temperature Ttb of the endless belt 83 so as to satisfy Ttb=TD=220° C. (S35).

After setting the target temperature Ttr of the fixing roller 60 and the target temperature Ttb of the endless belt 83 in S32, S34, or S35, the control section 90 determines whether or not a surface temperature of the fixing roller 60 is not lower than the target temperature Ttr (S36). If NO in S36, the control section 90 determines whether or not a temperature of the endless belt 83 is not lower than the target temperature Ttb (S37). If YES in S37, the control section 90 turns on the heater lamp 64 (H1=ON), and turns off the heater lamps 84 and 85 (H2=OFF) (S38). Then, the processing is returned to S36. If NO in S37, the control section 90 turns off the heater lamp 64 (H1=OFF), and turns on the heater lamps 84 and 85 (H2=ON) (S39). Then, the processing is returned to S36.

If YES in S36, the control section 90 causes the fixing process to be carried out (S40), and then determines whether to carry out a fixing process of a next recording material (S41). In a case where it is determined that the fixing process is carried out with respect to the next recording material, the process is returned to S31. In a case where it is determined that no fixing process is carried out with respect to the next recording material, the fixing process mode is ended, and then the ready mode is carried out.

In the present embodiment, the target temperature of the pressure roller 70 in the fixing process is set to 140° C., regardless of (i) a type of a recording material and (ii) an elapsed time from completion of the warm-up mode. Then, the control section 90 controls the heater lamp 74 inside the pressure roller 70 to be turned OFF while the heater lamps 84 and 85 are turning ON. In addition, in a case where the heater lamps 84 and 85 are turned OFF, the control section 90 controls (i) the heater lamp 74 to be turned ON until the surface temperature of the pressure roller 70 reaches the target temperature of the pressure roller 70 and (ii) the heater lamp 74 to be turned off when the surface temperature of the pressure roller 70 has reached the target temperature.

<4. Experimental Result>

The following describes results of experiments which were conducted for checking a fixing capability of the fixing device 1 of the present embodiment.

<4-1. Experiment 1>

With respect to the following examples 1 through 3 and comparative examples 1 through 3, it was checked whether or not an envelope was wrinkled and whether or not inadequate fixing was caused, (i) in a case where a fixing process was carried out immediately after a warm-up was completed and (ii) in a case where a fixing process was carried out after a ready state (after 120 seconds have elapsed from completion of a warm-up). In the examples 1 through 3 and the comparative examples 1 through 3, (i) a set temperature (target temperature) of the fixing roller 60 and (ii) a set temperature (target temperature) of the endless belt 83 are different from each other and are used when a fixing process was carried out with respect to an envelope by use of the color image forming apparatus 10.

Note that the recording material was an envelope having a size of 235 mm×120 mm and a thickness of 0.21 mm (basis weight: 85 g/m$^2$, manufactured by Haguruma Envelope Co., Ltd.). A speed at which the recording material was carried was set to 113 mm/s.

Note also that in the examples 1 and 2, and the comparative examples 1 and 2, respective target temperatures of the fixing roller 60 and the endless belt 83 were set as below where: TA is a target temperature (set temperature) of the fixing roller 60 and TC is a target temperature (set temperature) of the endless belt 83 in a fixing process carried out immediately after a warm-up is completed (before 120 seconds elapsed from completion of the warm-up); TB is a target temperature (set temperature) of the fixing roller 60 and TD is a target temperature (set temperature) of the endless belt 83 in a fixing process carried out after the ready state is ended (after a sufficiently long time period (120 seconds or longer) elapsed after the warm-up mode is shifted to the ready state). A target temperature (set temperature) of the pressure roller 70 was set to 140° C. in each case.

Example 1

TA=190° C.; TB=200° C.; TC=230° C.; TD=220° C.

Example 2

TA=190° C.; TB=200° C.; TC=220° C.; TD=220° C.

Example 3

TA=190° C.; TB=190° C.; TC=220° C.; TD=205° C.

Example 4

TA=195° C.; TB=200° C.; TC=230° C.; TD=220° C.

Comparative Example 1

TA=200° C.; TB=200° C.; TC=220° C.; TD=220° C.

Comparative Example 2

TA=190° C.; TB=220° C.; TC=190° C.; TD=220° C.

Comparative Example 3

TA=190° C.; TB=205° C.; TC=190° C.; TD=205° C.

FIG. 6 shows results of the experiments. Whether or not a wrinkle was caused was visually checked. In FIG. 6, "○" indicates nonoccurrence of a wrinkle whereas "x" indicates an occurrence of a wrinkle. As to whether or not inadequate fixing was caused, a fixation degree was visually checked. In FIG. 6, "○" indicates that there was no problem whereas "x" indicates that a fixation degree decreased to a level that causes a practical problem.

As is clear from FIG. 6, in each of the examples 1 through 4, i.e., by satisfying TA≦TB and TC≧TD, it was possible to prevent an occurrence of a wrinkle and an occurrence of a fixation failure in both a fixing process carried out immediately after a warm-up was completed and a fixing process carried out after the ready state was ended.

On the other hand, in the case of TA=TB=200° C. and TC=TD=220° C. in the comparative example 1, a wrinkle was caused in the fixing process carried out immediately after the warm-up was completed. In the case of TA=TC=190° C. and TB=TD=220° C. in the comparative example 2, a fixation failure was caused in the fixing process carried out after the ready state was ended. In the case of TA=TC=190° C. and TB=TD=205° C. in the comparative example 3, a wrinkle was caused in the fixing process carried out immediately after the warm-up was completed.

<4-2. Experiment 2>

The following describes results of experiments conducted for checking a relation between (i) target temperatures (set temperatures) of the fixing roller 60 and the endless belt 83 and (ii) durability of the fixing roller 60.

In the experiments, first, a fixing process was carried out, immediately after a warm-up was completed, with respect to the example 2 above and the comparative example 4 below so as to sequentially process 999 envelopes. Note that a set temperature of the pressure roller 70 was 140° C. in each case.

Example 2

TA=190° C.; TC=220° C.

Comparative Example 4

TA=200° C.; TC=195° C.

A fixing process was carried out, after the ready state, with respect to the example 2 above and the comparative example 5 below so as to sequentially process 999 envelopes. Note that a set temperature of the pressure roller 70 was 140° C. in each case.

Example 2

TB=200° C.; TD=220° C.

Comparative Example 5

TB=205° C.; TD=200° C.

The experimental results of the example 2 demonstrates that a bearing, a drive gear, etc. of the fixing roller 60 were not damaged in both (i) the fixing process carried out immediately after the warm-up was completed and (ii) the fixing process carried out after the ready state. Note that the present embodiment (the examples and comparative examples above) adopted, as the drive gear of the fixing roller 60, a gear made from PPS (polyphenylene sulfide).

In contrast, the experimental results of the comparative example 4 demonstrates that the drive gear of the fixing roller 60 was somewhat melted. The experimental results of the comparative example 5 demonstrates that the drive gear was melted and deformed.

<4-3. Experiment 3>

The following describes results of experiments in each of which a relation in the example 1 between (i) an elapsed time from completion of a warm-up to start of a fixing process and (ii) whether or not a wrinkle was caused was checked.

In the experiments, a set temperature (target temperature) of the fixing roller 60 was 200° C.; a set temperature (target temperature) of the endless belt 83 was 220° C.; a set temperature (target temperature) of the pressure roller 70 was 140° C. It was checked whether or not a wrinkle was caused in cases where an elapsed time from completion of a warm-up to a start of a fixing process of an envelope was changed to 0, 30, 60, 90, 120, 150, or 180 seconds.

FIG. 7 shows results of the experiments. Under each of the conditions above, 10 envelopes were subjected to a fixing process. In FIG. 7, "x" indicates that 3 out of 10 envelopes were wrinkled. "Δ" indicates that 1 or 2 out of 10 envelopes were wrinkled. "○" indicates that none of 10 envelopes was wrinkled.

As shown in FIG. 7, 3 or more out of 10 envelopes were wrinkled in a case where the elapsed time was not longer than 60 seconds. In a case where an elapsed time from completion of a warm-up was 90 seconds, 2 out of 10 envelopes were wrinkled. On the other hand, in a case where an elapsed time from completion of a warm-up was not shorter than 120 seconds, none of 10 envelopes was wrinkled.

Figure 8:
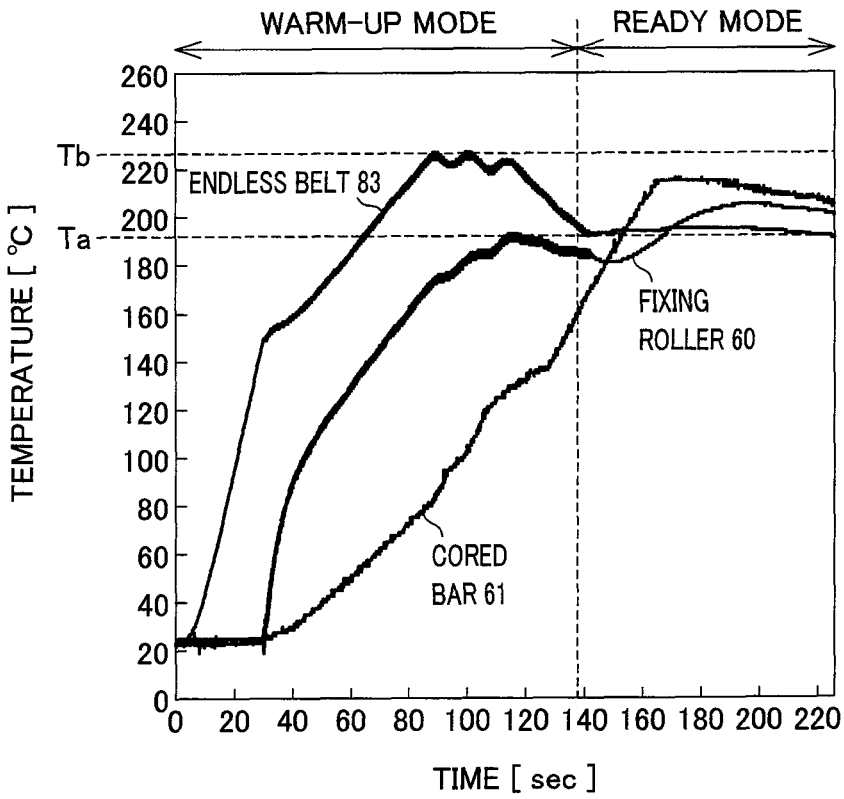
FIG. 8 is a graph showing, for the warm-up mode and the ready mode, respective temperature changes of a surface of a fixing roller, a core pipe of the fixing roller, and an endless belt.
Figure 9:
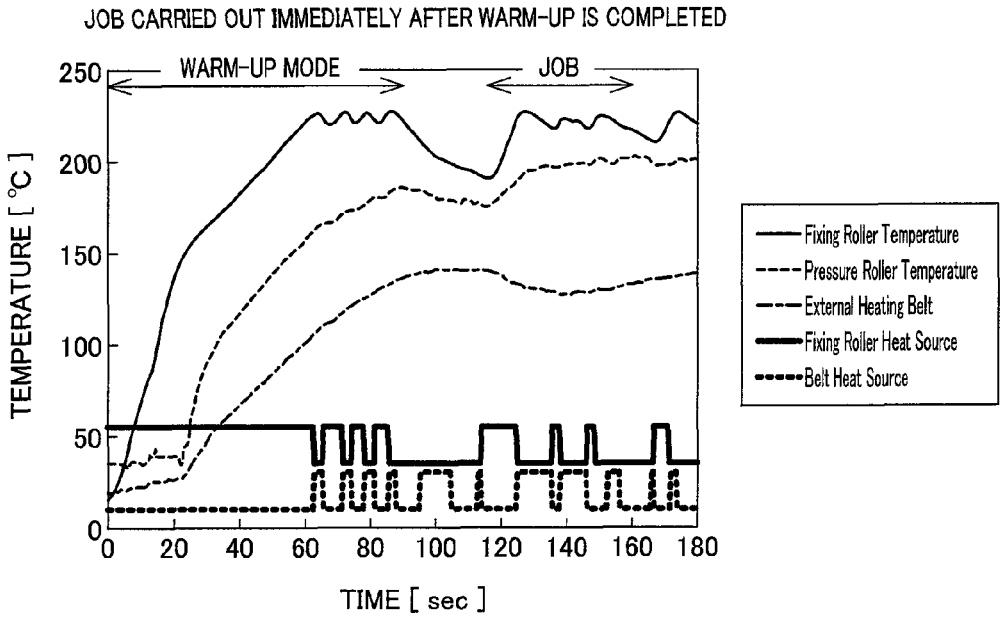
FIG. 9 PRIOR ART
FIG. 9 is a graph showing (i) how temperatures of the fixing roller, a pressure roller, and the endless belt change over time, and (ii) how ON/OFF states of a heat source inside the fixing roller and a heat source of an external heating belt change over time in a case where a fixing process is carried out by a conventional fixing device immediately after a warm-up is completed.
Figure 10:
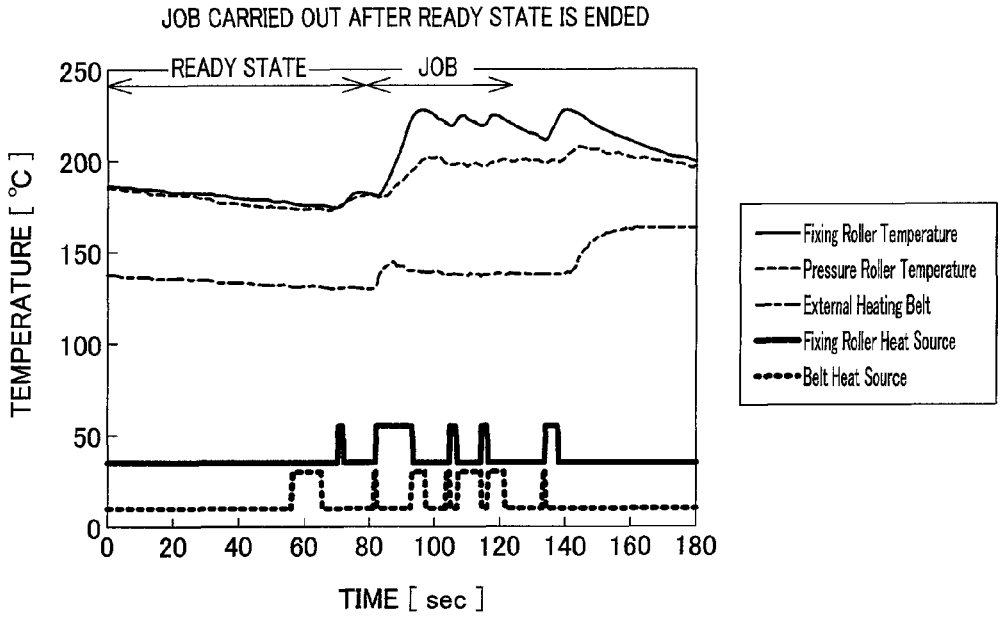
FIG. 10 PRIOR ART
FIG. 10 is a graph showing (i) how temperatures of the fixing roller, the pressure roller, and the endless belt change over time, and (ii) how ON/OFF states of the heat source inside the fixing roller and the heat source of the external heating belt change over time in a case where a fixing process is carried out after a ready state is ended.

The reason for the results is described below, with reference to FIG. 8. FIG. 8 is a graph showing, in the warm-up mode and the ready mode, how each of (i) the endless belt 83, (ii) the surface of the fixing roller 60, and (ii) the core pipe 61 of the fixing roller 60 changes depending on temperature. As is clear from FIG. 8, the core pipe 61 of the fixing roller 60 still has a low temperature for approximately 40 seconds after a warm-up is completed. Therefore, heat on the surface of the fixing roller 60 is diffused toward the core pipe 61, thereby decreasing a surface temperature of the fixing roller 60. Therefore, even if (i) the set temperatures of the fixing roller 60 and the endless belt 83 are set so that TA<TB and TC>TD are satisfied and (ii) heating of the endless belt 83 is started by starting the fixing process mode within 40 seconds after completion of the warm-up, a ratio at which the heater lamp 64 inside the fixing roller 60 turns ON becomes high because the surface of the fixing roller 60 cannot be sufficiently heated before the endless belt 83 reaches its target temperature. Since this leads to an overshoot of the fixing roller 60, an envelope is wrinkled due to thermal expansion of the fixing roller 60.

In the ready mode which starts immediately after a warm-up is completed, heating is carried out mainly by the heater lamp 64 provided inside the fixing roller 60. Therefore, as is clear from FIG. 8, a temperature of the core pipe 61 of the fixing roller 60 (i) increases immediately after a warm-up is completed, (ii) reaches a peak (maximum ultimate temperature) when approximately 50 seconds have elapsed since the warm-up is completed, and then (iii) decreases gradually. As shown in FIG. 8, the core pipe 61 keeps a high temperature until 40 seconds to 90 seconds have elapsed since the warm-up is completed. As a result, an envelope is wrinkled due to thermal expansion of the fixing roller 60.

Therefore, it is preferable that the set temperatures used when a fixing process is carried out with respect to an envelope be changed at a timing (i) when a temperature of the core pipe 61 of the fixing roller 60 passes its peak and then decreases to a predetermined temperature or lower (i.e., a temperature which causes the thermal expansion of the fixing roller 60 to be decreased to the extent that the recording material is not wrinkled) and (ii) after a shift to the ready state which follows completion of the warm-up. For this reason, according to the present embodiment, set temperatures for a fixing process of an envelope are changed depending on whether or not 120 seconds elapse from completion of a warm-up.

As described above, in the present embodiment, respective set temperatures of the fixing roller 60 and the endless belt 83 are changed according to an elapsed time from completion of a warm-up to acceptance of a job to be processed in the fixing process (i.e., to start of the fixing process). Specifically, the set temperatures TA and TB are set so as to satisfy TA<TB where TA indicates a set temperature of the fixing roller 60 in a case where a job is accepted immediately after a warm-up is completed whereas TB indicates a set temperature of the fixing roller 60 in a case where a job is accepted after a predetermined time period (120 seconds in the present embodiment) elapses from completion of a warm-up. In addition, set temperatures TC and TD are set so as to satisfy TC>TD where TC indicates a set temperature of the endless belt 83 in a case where a job is accepted immediately after a warm-up is completed whereas TD indicates a set temperature of the endless belt 83 in a case where a job is accepted after a predetermined time period (120 seconds in the present embodiment) elapses from completion of a warm-up.

A set temperature of the fixing roller 60 for a fixing process with respect to an envelope to be carried out immediately after a warm-up is completed is thus set lower than a set temperature of the fixing roller 60 for a fixing process with respect to an envelope to be carried out after a predetermined time period or more elapses since completion of a warm-up. This makes it possible to prevent thermal expansion of the fixing roller 60 from increasing. In addition, a set temperature of the endless belt 83 for a fixing process with respect to an envelope to be carried out immediately after a warm-up is completed is set higher than a set temperature of the endless belt 83 for a fixing process with respect to an envelope to be carried out after a predetermined time period or more elapses from completion of a warm-up. Accordingly, a proportion in which the heater lamps 84 and 85 provided inside the external heating device 80 heat the fixing roller 60 is increased with respect to a proportion in which the heater lamp 64 provided inside the fixing roller 60 heats the fixing roller 60. This prevents the inner-surface side of the fixing roller 60 from being overheated by the heater lamp 64. As such, it becomes possible to prevent thermal expansion of the fixing roller 60 from increasing. Therefore, it is possible to prevent a recording material from being wrinkled by a large pressure caused by too large thermal expansion of the fixing roller 60.

In a case where a fixing process is carried out with respect to an envelope after a predetermined time period elapses from completion of a warm-up, a set temperature of the fixing roller 60 is set higher than a set temperature of the fixing roller 60 for a fixing process with respect to an envelope to be carried out immediately after a warm-up is completed. This makes it possible to increase a heat input to the fixing roller 60. In addition, a set temperature of the endless belt 83 for a fixing process with respect to an envelope after a predetermined time period or more elapses from completion of a warm-up is set lower than a set temperature of the endless belt 83 for a fixing process with respect to an envelope to be carried out immediately after a warm-up is completed. Accordingly, a proportion in which the heater lamp 64 provided inside the fixing roller 60 heats the fixing roller 60 is increased with respect to a proportion in which the heater lamps 84 and 85 provided inside the external heating device 80 heat the fixing roller 60. This makes it possible to increase a heat input to the fixing roller 60. Accordingly, even if a pressure acting on a recording material decreases due to a small thermal expansion of the fixing roller 60, a sufficient amount of heat can be applied from the fixing roller 60 to toner on the recording material so that the toner is properly fixed. As a result, a fixation failure such as a low-temperature offset can be prevented.

According to the present embodiment, a set temperature of the endless belt 83 is set higher than a set temperature of the fixing roller 60 in a fixing process, i.e., is set so that TC>TA and TD>TB are satisfied.

This can prevent members such as the bearing and the drive gear from being damaged due to a too high temperature of the core pipe 61 of the fixing roller 60 caused by a too large heat generation of the heater lamp 64 provided inside the fixing roller 60.

In the present embodiment, respective set temperatures of the fixing roller 60 and the endless belt 83 are set in two levels for both cases where a job is accepted before the predetermined time period (in the present embodiment, 120 seconds) elapses from completion of a warm-up and where a job is accepted after the predetermined time period elapses. However, the present embodiment is not limited to this. Note that each set temperature of the fixing roller 60 and the endless belt 83 can be determined in a multistage manner or can be set continuously, in accordance with an elapsed time from completion of a warm-up to acceptance of a job. For example, the set temperatures of the fixing roller 60 and the endless belt 83 can be determined so that the set temperature of the fixing roller 60 becomes higher whereas the set temperature of the endless belt 83 becomes lower, as the elapsed time becomes longer.

According to the present embodiment, both set temperatures of the fixing roller 60 and the endless belt 83 are changed in accordance with an elapsed time from completion of a warm-up to acceptance of a job. However, the present embodiment is not limited to this. Instead, at least one of the set temperatures can be changed. This also allows substantially the same effect to be obtained.

Although the present embodiment deals with a case where two types of recording materials are used, i.e., sheets of plain paper and envelopes, the present embodiment is not limited to this. For example, a recording material can be subjected to a process similar to the aforementioned fixing process carried out with respect to the envelopes in a case where such a recording material is a predetermined type of recording material for which a target temperature (set fixing temperature) of the fixing roller 60 needs to be set higher, by a predetermined temperature or more, than a warm-up completion temperature. The predetermined type of recording material can be a recording material such as (i) a recording material having a plurality of sheet parts which overlap each other (e.g., an envelope, a recording material in which a plurality of sheets of paper are bonded, and a recording material made by folding back one piece of paper so that a part of the one piece of paper and another part of the one piece of paper overlap each other (e.g., a recording material having a part folded, for example, in a Z-shape)) or a recording material having a predetermined thickness or more. Further, each set temperature of the fixing roller 60 and the endless belt 83 can be determined in accordance with a corresponding type of recording material in case of three or more types of recording materials.

The present embodiment deals with a case where the external heating device 80 is provided which is arranged such that the heated endless belt 83 makes contact with the outer surface of the fixing roller 60, thereby heating the surface of the fixing roller 60. However, the present embodiment is not limited to this. Alternatively, it is possible to use an external heating device 80 arranged to be provided so as to face the fixing roller 60 in a noncontact manner.

The present embodiment deals with an arrangement in which toner images are directly transferred from the visible image forming units 40 onto the recording material P. However, an arrangement of an image forming apparatus to which the present invention is applied is not limited to this. For example, it can be arranged such that the toner images are transferred from the visible image forming units 40 onto an intermediate transfer member such as a belt, and then, the toner images are secondarily transferred from the intermediate transfer member onto the recording material P.

The present embodiment deals with a color image forming apparatus using cyan toner, yellow toner, magenta toner, and black toner. However, the present embodiment is not limited to this. For example, the color image forming apparatus can use the following 6 colors of toner: cyan, yellow, magenta, black, light cyan, and light magenta. Alternatively, a monochrome image forming apparatus can be used which uses only monochrome toner.

In the present embodiment, the control section 90 can be a control integrated circuit substrate. Alternatively, the control section 90 can be realized by way of software as executed by a CPU as follows:

In a case where the control section 90 is realized by way of software, the control section 90 includes a CPU (central processing unit) and memory devices (memory media). The CPU (central processing unit) executes instructions in control programs realizing the functions. The memory devices include a ROM (read only memory) which contains programs, a RAM (random access memory) to which the programs are loaded, and a memory containing the programs and various data.

The objective of the present invention can also be achieved by mounting to the control section 90 a computer-readable storage medium containing control program code (executable program, intermediate code program, or source program) for the control section 90, which is software realizing the aforementioned functions, in order for the computer (or CPU, MPU) to retrieve and execute the program code contained in the storage medium. The storage medium may be, for example, a tape, such as a magnetic tape or a cassette tape; a magnetic disk, such as a Floppy® disk or a hard disk, or an optical disk, such as CD-ROM/MO/MD/DVD/CD-R/BD; a card, such as an IC card (memory card) or an optical card; or a semiconductor memory, such as a mask ROM/EPROM/EEPROM/flash ROM.

The control section 90 may be arranged to be connectable to a communications network so that the program code may be delivered over the communications network. The communications network is not limited in any particular manner, and may be, for example, the Internet, an intranet, extranet, LAN, ISDN, VAN, CATV communications network, virtual dedicated network (virtual private network), telephone line network, mobile communications network, or satellite communications network. The transfer medium which makes up the communications network is not limited in any particular manner, and may be, for example, wired line, such as IEEE 1394, USB, electric power line, cable TV line, telephone line, or ADSL line; or wireless, such as infrared radiation (IrDA, remote control), WiMAX, Bluetooth®, 802.11 wireless, HDR, mobile telephone network, satellite line, or terrestrial digital network.

The present invention can be also realized by the program code in the form of a computer data signal (data signal transmission) embedded in a carrier wave which is embodied by electronic transmission.

As described above, the fixing device of the present invention includes: a fixing member including a cylindrical core pipe and an elastic layer covering an outer surface of the cylindrical core pipe, the fixing member being rotatably provided around an axis extending in which the cylindrical core pipe extends; a pressure member which pressures the fixing member; an internal heating section, provided inside the fixing member, for heating the fixing member from within; an external heating section, provided so as to face an outer surface of the fixing member, for heating the outer surface of the fixing member; a first temperature sensing section for detecting a temperature of a contact surface of the fixing member, the contact surface making contact with the pressure member; a second temperature sensing section for detecting a temperature of a facing surface of the external heating section, the facing surface facing the fixing member; and a control section for controlling the internal heating section and the external heating section in accordance with results detected by the respective first and second temperature sensing sections, said fixing device causing a recording material, inserted between the fixing member and the pressure member, to be carried while the recording material is being sandwiched so that an unfixed image on the recording material is fixed onto the recording material, said control section having (i) a warm-up mode in which a surface of the fixing member is heated up to a predetermined warm-up completion temperature, (ii) a standby mode in which the surface of the fixing member is maintained within a predetermined standby temperature range, during a time period in which no fixing process is carried out and after the warm-up mode is completed, and (iii) a fixing process mode in which a fixing process is carried out with respect to the recording material, and, said control section changing, in accordance with a time period between an end of the warm-up mode and a start of the fixing process mode, at least one of (i) a set fixing temperature which is a set temperature of the contact surface of the fixing member in a fixing process and (ii) a set external heating temperature which is a set temperature of the facing surface of the external heating section in a fixing process, in a case where a fixing process is carried out, in the fixing process mode, with respect to a predetermined type of recording material for which the set fixing temperature needs to be set higher, by a predetermined temperature or more, than the warm-up completion temperature.

According to the arrangement, the fixing device includes: the fixing member which includes the cylindrical core pipe and the elastic layer covering the outer surface of the cylindrical core pipe; the internal heating section for heating the fixing member from within; and the external heating section for heating the outer surface of the fixing member which external heating section is provided so as to face the outer surface of the fixing member. In addition, the fixing device includes: the first temperature sensing section for detecting the temperature of the surface of the fixing member; the second temperature sensing section for detecting the temperature of the surface of the external heating section which surface faces the fixing member; and the control section for controlling the internal heating section and the external heating section on the basis of respective detection results of the first temperature sensing section and the second temperature sensing section. Further, the control section has: the warm-up mode for heating the fixing member so that a surface temperature of the fixing member is increased to the predetermined warm-up completion temperature; the standby mode for maintaining the surface temperature of the fixing member within the predetermined standby temperature range in the period in which no fixing process is carried out and which period comes after the warm-up mode is completed; and the fixing process mode for carrying out a fixing process of the recording material.

In the case of such a fixing device, respective temperatures of the core pipe and the elastic layer which are provided in the fixing member can differ between immediately after the warm-up mode is completed and after a long time period elapses since the standby mode is started, even if a surface temperature of the fixing member is the same.

Therefore, according to the arrangement, in accordance with the time period between the end of the warm-up mode and the start of the fixing process mode, the control section changes at least one of (i) the set fixing temperature which is a set temperature of the contact surface of the fixing member in a fixing process and (ii) the set external heating temperature which is a set temperature of the facing surface of the external heating section in a fixing process, in a case where a fixing process is carried out, in the fixing process mode, with respect to a predetermined type of recording material for which the set fixing temperature needs to be set higher, by a predetermined temperature or more, than the warm-up completion temperature. This makes it possible to prevent the recording material from being wrinkled by a too large pressure caused by a too large thermal expansion of the fixing member, even if a process is carried out in the fixing process mode with respect to the predetermined type of recording material for which a set fixing temperature needs to be set higher, by the predetermined value or more, than the warm-up completion temperature. In addition, this makes it possible to prevent inadequate fixing, such as a low-temperature offset, which is caused because a pressure acting on the recording material is too small due to a too small thermal expansion of the fixing member.

The external heating section can be arranged to heat the outer surface of the fixing member while making contact with the outer surface of the fixing member.

According to the arrangement, the heated member makes contact with the outer surface of the fixing member. This makes it possible to efficiently heat the outer surface of the fixing member.

Further, in a case where a fixing process is carried out, in the fixing process mode, with respect to the predetermined type of recording material, the control section may set lower the set external heating temperature as the time period between the end of the warm-up mode and the start of the fixing process mode is longer. For example, the control section may satisfy TC>TD, where (i) TC is a set external heating temperature which is set in a case where the time period between the end of the warm-up mode and the start of the fixing process mode is shorter than a predetermined time period and (ii) TD is a set external heating temperature which is set in a case where the time period is not shorter than the predetermined time period.

According to the arrangement, in a case where an elapsed time from an end of the warm-up mode is short, a proportion of heating carried out by the external heating section is increased with respect to a proportion of heating carried out by the internal heating section. This makes it possible to prevent a recording material from being wrinkled by a too large pressure which is caused because thermal expansion of the fixing member becomes too large due to overheating of an internal surface side of the fixing member. In a case where an elapsed time from an end of the warm-up mode is long, a proportion of heating carried out by the internal heating section is increased with respect to a proportion of heating carried out by the external heating section. This makes it possible to prevent inadequate fixing, such as a low-temperature offset, which is caused because a pressure acting on the recording material is insufficient due to a too small thermal expansion of the fixing member.

Further, in a case where a fixing process is carried out, in the fixing process mode, with respect to the predetermined type of recording material, the control section may set higher the set fixing temperature as the time period between the end of the warm-up mode and the start of the fixing process mode is longer. For example, the control section may satisfy TA<TB, where (i) TA is a set fixing temperature which is set in a case where the time period between the end of the warm-up mode and the start of the fixing process mode is shorter than a predetermined time period and (ii) TB is a set fixing temperature which is set in a case where the time period is not shorter than the predetermined time period.

According to the arrangement, in a case where an elapsed time from an end of the warm-up mode is short, a set temperature of the fixing member is set lower than that of the case where the elapsed time is long. This makes it possible to prevent the recording material from being wrinkled by a too large pressure caused by a too large thermal expansion of the fixing member. In addition, in a case where an elapsed time from an end of the warm-up mode is long, a set temperature of the fixing member is set higher than that of the case where the elapsed time is short. This increases a heat input to the fixing member. As a result, this makes it possible to prevent inadequate fixing, such as a low-temperature offset, which is caused because a pressure acting on the recording material is insufficient due to a too small thermal expansion of the fixing member.

Further, in a case where a process of the standby mode is continuously carried out after the warm-up mode is shifted to the standby mode upon completion of the warm-up mode, the control section may set longer the predetermined time period than a time period which follows the completion of the warm-up mode and continues until the cylindrical core pipe reaches a maximum ultimate temperature.

This makes it possible to properly prevent the recording material from being wrinkled by a too large pressure caused by a too large thermal expansion of the fixing member.

Further, the control section may set the set external heating temperature higher than the set fixing temperature.

This makes it possible to prevent the core pipe of the fixing member from having a too high temperature. As a result, this makes it possible to prevent members such as the bearing of the fixing member and the drive gear for driving the fixing member to rotate from being damaged by heat.

Further, the predetermined type of recording material can be a recording material having a plurality of seat sections which overlap each other. The recording material having a plurality of seat sections which overlap each other is, for example, an envelope, a recording material made by folding one piece of paper so that a part of the one piece of paper overlaps another part of the one piece of paper, a recording material in which a plurality of sheets of paper are bonded, or the like.

This arrangement makes it possible to prevent a wrinkle and inadequate fixing even if such a recording material is subjected to a fixing process.

An image forming apparatus of the present invention includes any of the fixing devices.

This makes it possible to prevent a wrinkle and inadequate fixing even if a fixing process is carried out with respect to the predetermined type of recording material for which a set fixing temperature needs to be set higher, by the predetermined value or more, than the warm-up completion temperature.

A method of the present invention for controlling a fixing device, said fixing device including: a fixing member including a cylindrical core pipe and an elastic layer covering an outer surface of the cylindrical core pipe, the fixing member being rotatably provided around an axis extending in which the cylindrical core pipe extends; a pressure member which pressures the fixing member; an internal heating section, provided inside the fixing member, for heating the fixing member from within; an external heating section, provided so as to face an outer surface of the fixing member, for heating the outer surface of the fixing member; a first temperature sensing section for detecting a temperature of a contact surface of the fixing member, the contact surface making contact with the pressure member; a second temperature sensing section for detecting a temperature of a facing surface of the external heating section, the facing surface facing the fixing member; and a control section for controlling the internal heating section and the external heating section in accordance with results detected by the respective first and second temperature sensing sections, said fixing device causing a recording material, inserted between the fixing member and the pressure member, to be carried while the recording material is being sandwiched so that an unfixed image on the recording material is fixed onto the recording material, the method includes: causing said control section to have (i) a warm-up mode in which a surface of the fixing member is heated up to a predetermined warm-up completion temperature, (ii) a standby mode in which the surface of the fixing member is maintained within a predetermined standby temperature range, during a time period in which no fixing process is carried out and after the warm-up mode is completed, and (iii) a fixing process mode in which a fixing process is carried out with respect to the recording material, and, changing, in accordance with a time period between an end of the warm-up mode and a start of the fixing process mode, at least one of (i) a set fixing temperature which is a set temperature of the contact surface of the fixing member in a fixing process and (ii) a set external heating temperature which is a set temperature of the facing surface of the external heating section in a fixing process, in a case where a fixing process is carried out, in the fixing process mode, with respect to a predetermined type of recording material for which the set fixing temperature needs to be set higher, by a predetermined temperature or more, than the warm-up completion temperature.

As is the case with the fixing device above, the method makes it possible to prevent the recording material from being wrinkled by a too large pressure caused by a too large thermal expansion of the fixing member, even if a process is carried out in the fixing process mode with respect to the predetermined type of recording material for which a set fixing temperature needs to be set higher, by the predetermined value or more, than the warm-up completion temperature. In addition, this makes it possible to prevent inadequate fixing, such as a low-temperature offset, which is caused because a pressure acting on the recording material is too small due to a too small thermal expansion of the fixing member.

The control section to be provided in the fixing device can be realized by a computer. In this case, the present invention encompasses (i) a control program for causing the computer to operate as the control section and (ii) a computer-readable recording medium storing the control program.

The present invention is not limited to the description of the embodiment above, but may be altered by a skilled person within the scope of the claims. An embodiment based on a proper combination of technical means disclosed in different embodiments is encompassed in the technical scope of the present invention.

Industrial Applicability

The present invention is applicable to a fixing device for use in an electrophotographic image forming apparatus such as a printer, a copying machine, a facsimile, or an MFP (Multi Function Printer).

Reference Signs List

1 Fixing device
10 Color image forming apparatus (image forming apparatus)
60 Fixing roller (fixing member)
61 Core pipe
62 Elastic layer
63 Release layer
64 Heater lamp (internal heating section)
65 Thermistor (first temperature sensing section)
70 Pressure roller (pressure member)
80 External heating device (external heating section)
81 and 82 Supporting rollers
83 Endless belt
84 and 85 Heater lamps
86 and 88 Thermistors (second temperature sensing means)
90 Control section
91 Rotary drive, device

The invention claimed is:

1. A fixing device comprising:

a fixing member including a cylindrical core pipe and an elastic layer covering an outer surface of the cylindrical core pipe, the fixing member being rotatably provided around an axis extending in which the cylindrical core pipe extends;

a pressure member which pressures the fixing member;

an internal heating section, provided inside the fixing member, for heating the fixing member from within;

an external heating section, provided so as to face an outer surface of the fixing member, for heating the outer surface of the fixing member;

a first temperature sensing section for detecting a temperature of a contact surface of the fixing member, the contact surface making contact with the pressure member;

a second temperature sensing section for detecting a temperature of a facing surface of the external heating section, the facing surface facing the fixing member; and a control section for controlling the internal heating section and the external heating section in accordance with results detected by the respective first and second temperature sensing sections, said fixing device causing a recording material, inserted between the fixing member and the pressure member, to be carried while the recording material is being sandwiched so that an unfixed image on the recording material is fixed onto the recording material, said control section having (i) a warm-up mode in which a surface of the fixing member is heated up to a predetermined warm-up completion temperature, (ii) a standby mode in which the surface of the fixing member is maintained within a predetermined standby temperature range, during a time period in which no fixing process is carried out and after the warm-up mode is completed, and (iii) a fixing process mode in which a fixing process is carried out with respect to the recording material, and, said control section changing, in accordance with a time period between an end of the warm-up mode and a start of the fixing process mode, at least one of (i) a set fixing temperature which is a set temperature of the contact surface of the fixing member in a fixing process and (ii) a set external heating temperature which is a set temperature of the facing surface of the external heating section in a fixing process, in a case where a fixing process is carried out, in the fixing process mode, with respect to a predetermined type of recording material for which the set fixing temperature needs to be set higher, by a predetermined temperature or more, than the warm-up completion temperature.

2. The fixing device as set forth in claim 1, wherein the external heating section heats the outer surface of the fixing member while making contact with the outer surface of the fixing member.

3. The fixing device as set forth in claim 1, wherein, in a case where a fixing process is carried out, in the fixing process mode, with respect to the predetermined type of recording material, said control section sets lower the set external heating temperature as the time period between the end of the warm-up mode and the start of the fixing process mode is longer.

4. The fixing device as set forth in claim 3, wherein said control section satisfies TC>TD, where (i) TC is a set external heating temperature which is set in a case where the time period between the end of the warm-up mode and the start of the fixing process mode is shorter than a predetermined time period and (ii) TD is a set external heating temperature which is set in a case where the time period is not shorter than the predetermined time period.

5. The fixing device as set forth in claim 4, wherein, in a case where a process of the standby mode is continuously carried out after the warm-up mode is shifted to the standby mode upon completion of the warm-up mode, said control section sets longer the predetermined time period than a time period which follows the completion of the warm-up mode and continues until the cylindrical core pipe reaches a maximum ultimate temperature.

6. The fixing device as set forth in claim 1, wherein, in a case where a fixing process is carried out, in the fixing process mode, with respect to the predetermined type of recording material, said control section sets higher the set fixing temperature as the time period between the end of the warm-up mode and the start of the fixing process mode is longer.

7. The fixing device as set forth in claim 6, wherein said control section satisfies TA<TB, where (i) TA is a set fixing temperature which is set in a case where the time period between the end of the warm-up mode and the start of the fixing process mode is shorter than a predetermined time period and (ii) TB is a set fixing temperature which is set in a case where the time period is not shorter than the predetermined time period.

8. The fixing device as set forth in claim 7, wherein, in a case where a process of the standby mode is continuously carried out after the warm-up mode is shifted to the standby mode upon completion of the warm-up mode, said control section sets longer the predetermined time period than a time period which follows the completion of the warm-up mode and continues until the cylindrical core pipe reaches a maximum ultimate temperature.

9. The fixing device as set forth in claim 1, wherein the control section sets the set external heating temperature higher than the set fixing temperature.

10. The fixing device as set forth in claim 1, wherein the predetermined type of recording material is a recording material having a plurality of seat sections which overlap each other.

11. An image forming apparatus comprising a fixing device recited in claim 1.

12. A computer-readable storage medium storing a program for causing a fixing device recited in claim 1 to operate, the program for causing a computer to function as the control section.

13. A method for controlling a fixing device, said fixing device comprising:

a fixing member including a cylindrical core pipe and an elastic layer covering an outer surface of the cylindrical core pipe, the fixing member being rotatably provided around an axis extending in which the cylindrical core pipe extends;

a pressure member which pressures the fixing member;

an internal heating section, provided inside the fixing member, for heating the fixing member from within;

an external heating section, provided so as to face an outer surface of the fixing member, for heating the outer surface of the fixing member;

a first temperature sensing section for detecting a temperature of a contact surface of the fixing member, the contact surface making contact with the pressure member;

a second temperature sensing section for detecting a temperature of a facing surface of the external heating section, the facing surface facing the fixing member; and a control section for controlling the internal heating section and the external heating section in accordance with results detected by the respective first and second temperature sensing sections, said fixing device causing a recording material, inserted between the fixing member and the pressure member, to be carried while the recording material is being sandwiched so that an unfixed image on the recording material is fixed onto the recording material, the method comprising:

causing said control section to have (i) a warm-up mode in which a surface of the fixing member is heated up to a predetermined warm-up completion temperature, (ii) a standby mode in which the surface of the fixing member is maintained within a predetermined standby temperature range, during a time period in which no fixing process is carried out and after the warm-up mode is completed, and (iii) a fixing process mode in which a fixing process is carried out with respect to the recording material, and, changing, in accordance with a time period between an end of the warm-up mode and a start of the fixing process mode, at least one of (i) a set fixing temperature which is a set temperature of the contact surface of the fixing member in a fixing process and (ii) a set external heating temperature which is a set temperature of the facing surface of the external heating section in a fixing process, in a case where a fixing process is carried out, in the fixing process mode, with respect to a predetermined type of recording material for which the set fixing temperature needs to be set higher, by a predetermined temperature or more, than the warm-up completion temperature.

* * * * *